United States Patent [19]

Gaia

[11] 4,041,435

[45] Aug. 9, 1977

[54] PROTECTOR FOR ELECTRIC CIRCUIT

[75] Inventor: Aldino J. Gaia, St. Louis, Mo.

[73] Assignee: McGraw-Edison Company, Elgin, Ill.

[21] Appl. No.: 511,059

[22] Filed: Oct. 1, 1974

[51] Int. Cl.[2] ..... H01H 85/04

[52] U.S. Cl. ..... 337/159; 337/161; 337/162; 337/229; 337/290; 337/295

[58] Field of Search ..... 337/159, 160, 161, 162, 337/229, 290, 293, 295, 296, 416

[56] References Cited

U.S. PATENT DOCUMENTS

| | | | |
|---|---|---|---|
| 1,299,132 | 4/1919 | Conant | 337/253 |
| 1,422,419 | 7/1922 | Conant | 337/248 X |
| 1,422,420 | 7/1922 | Conant | 337/234 |
| 1,919,273 | 7/1933 | Conant | 337/237 |
| 1,991,876 | 2/1935 | Wood | 337/233 |
| 2,055,115 | 9/1936 | Wood | 337/234 X |
| 2,079,097 | 5/1937 | Wood | 337/233 |
| 2,720,567 | 10/1955 | Detch | 337/295 |
| 2,826,660 | 3/1958 | Kozacka | 337/293 X |
| 2,834,852 | 5/1958 | Swain et al. | 337/244 |
| 3,611,239 | 10/1971 | Kozacka | 337/162 |

FOREIGN PATENT DOCUMENTS

| | | | |
|---|---|---|---|
| 59,310 | 5/1891 | Germany | 337/159 |

*Primary Examiner*—J D Miller

*Assistant Examiner*—Fred E. Bell

*Attorney, Agent, or Firm*—Rogers, Eilers & Howell

[57] ABSTRACT

The fusible element of an electric fuse has a first electrical path, a second electrical path in parallel relation with the first electrical path, a weak spot in the first electrical path which can respond to a potentially-hurtful overcurrent to fuse and thereby form a first arc in the first electrical path, and a weak spot in the second electrical path longitudinally displaced from the weak spot in the first electrical path which can respond to that overcurrent to fuse and thereby form a first arc in the second electrical path. The weak spots form primary arcs as they fuse; and one important function of those primary arcs is to establish the point at which the rate of rise of the overcurrent starts to diminish, while another important function of those primary arcs is to burn the adjacent portions of the respective electrical conducting paths. When enough of the cross sections of those adjacent portions have burned to enable those adjacent portions to fuse, secondary arcs will develop at those adjacent portions; and an important function of those secondary arcs is to provide the desirable current-interrupting characteristics that the series-arranged weak spots of a fusible element can provide when they fuse simultaneously.

72 Claims, 46 Drawing Figures

424
432
440
426
434
442
444
428
436
448
446
430
450
438

544
550
540
548
546
552
558
542
556
554
538

458
466
454
468
460
470
462
456
472
464
452

608
606
600
610
602
604

576
570
562
580
578
572
564
560
582
574
590
584
566
594
592
586
568
596
588

474
480
476
478
34
34

474
478

482
488
486
484
36
36

482
486
510

524
516
534
526
530
512
514
520
522
528
518
532
536

PROTECTOR FOR ELECTRIC CIRCUIT

BACKGROUND OF THE INVENTION

Most fusible elements of electric fuses have weak spots in the electrical conducting paths between the terminals thereof. Those weak spots help limit the maximum values of current which can flow through those electric fuses in the event of a potentially hurtful overcurrent; but those weak spots increase the overall electrical resistance values of those electric fuses and also increase the amount of heat generated by those electric fuses. Where two or more series-arranged weak spots are provided in any given electrical conducting path within an electric fuse, that electric fuse can be incorporated into a circuit which has a higher voltage than a circuit which includes an electric fuse that has a similar electrical conducting path with just one weak spot therein. However, an electrical conducting path which has two or more series-arranged weak spots therein has a greater electrical resistance value and will generate more heat than will a similar electrical conducting path which has just one similar weak spot therein. In addition, the arcs which form at the weak spots of most electric fuses must perform two diverse arcing functions; namely, the establishing of the point at which the available overload current must start to level off, and the controlling of the length of time during, and the rate at, which the current is reduced to zero. Because those arcs must perform such diverse arcing functions, the weak spots where those arcs will form can not be dimensioned to perform both of those arcing functions with maximum efficiency.

SUMMARY OF THE INVENTION

The present invention provides a fusible element for an electric fuse which has a first electrical conducting path, a second electrical conducting path in electrical parallel relation with the first electrical conducting path, a weak spot in the first electrical conducting path which can respond to a potentially hurtful overcurrent to fuse and thereby form a first arc in the first electrical conducting path, and a weak spot in the second electrical conducting path which is longitudinally displaced from the weak spot in the first electrical conducting path and which can respond to that overcurrent to fuse and thereby form a first arc in the second electrical conducting path. The weak spots in the electrical conducting paths form primary arcs in those electrical conducting paths as they fuse; and one important function of those primary arcs is to establish the point at which the rate of rise of the overcurrent starts to diminish, while another important function of those primary arcs is to burn the adjacent portions of the respective electrical conducting paths. When enough of the cross sections of the adjacent portions have burned to enable those adjacent portions to fuse, secondary arcs will develop at those adjacent portions; and an important function of those secondary arcs is to provide the desirable current-interrupting characteristics that the series-arranged weak spots of a fusible element can provide when they fuse simultaneously. It is, therefore, an object of the present invention to provide a fusible element for an electric fuse with two parallel-arranged electrical conducting paths, to provide a weak spot in each of those electrical conducting paths which can fuse to form a primary arc that will establish the point at which the rate of rise of the overcurrent will start to diminish, and to provide portions of those electrical conducting paths which can respond to burning caused by those primary arcs to fuse and form secondary arcs which will provide the desirable current-interrupting characteristics that the series-arranged weak spots of a fusible element can provide when they fuse simultaneously.

The weak spot in any given electrical conducting path, of each fusible element provided by the present invention, will fuse before any nearby portion of that electrical conducting path fuses; and hence that weak spot is considered to be a controlling weak spot. The portion of the adjacent electrical conducting path, which responds to the arc at the controlling weak spot in the given electrical conducting path to burn sufficiently to fuse, is considered to be a dependent weak spot. Each electric fuse provided by the present invention provides at least two burning paths which extend transversely of that electric fuse and which extend from the controlling weak spots into the transversely-spaced dependent weak spots of that electric fuse; and those burning paths will burn away before any path, which lies between the arcs that form as the longitudinally-spaced controlling weak spots fuse, can burn away. Consequently, the arc which forms as any given controlling weak spot fuses will cause the dependent weak spot in the adjacent electrical conducting path to burn sufficiently to fuse — and thereby form one wide arc — before the arc at that controlling weak spot can burn far enough longitudinally of that electric fuse to merge with the arc which forms as a longitudinally-spaced controlling weak spot fuses. It is, therefore, an object of the present invention to provide a fusible element for an electric fuse that provides at least two burning paths which extend transversely of that electric fuse and which extend from the controlling weak spots into the transversely-spaced dependent weak spots of that electric fuse; and those burning paths will burn away before any path, which lies between the arcs that form as the longitudinally-spaced controlling weak spots fuse, can burn away.

Because the controlling weak spots develop primary arcs which perform the arcing function of establishing the point at which the rate of rise of the overcurrent must start to diminish, the adjacent portions of the respective electrical conducting paths do not have to be dimensioned to enable the secondary arcs, which form as those adjacent portions burn sufficiently to fuse, to perform that arcing function. Consequently, those adjacent portions can be given desirable configurations and cross sections. Because the secondary arcs, which form as the adjacent portions of the respective electrical conducting paths fuse, largely perform the arcing function of controlling the length of time during, and the rate at, which the current is reduced to zero, the controlling weak spots do not have to be dimensioned to enable the primary arcs, which form at those controlling weak spots, to perform that function. Consequently, the cross sections of the controlling weak spots can be made relatively small; and hence the primary arcs which form as those controlling weak spots fuse enable the electric fuse to establish a relatively low point at which the rate of rise of the overcurrent must start to diminish. It is, therefore, an object of the present invention to provide a fusible element for an electric fuse wherein the cross sections of the controlling weak spots are made relatively small to establish a relatively low point at which the rate of rise of the overcurrent must start to diminish; and wherein the adjacent portions of the respective electrical conducting paths fuse to provide secondary arcs that largely perform the arcing function of controlling the length of time during; and the rate at, which the current is reduced to zero.

Many of the embodiments of the fusible element provided by the present invention have both of the electrical conducting paths thereof formed from, and constituting integral parts of, the same piece of metal. In such embodiments, each electrical conducting path contributes its share of the strength and ruggedness of the fusible element. Moreover, because the portion of the first electrical conducting path, of each of those embodiments, which is in register with the controlling weak spot in the second electrical conducting path of that embodiment has a cross section which is larger than the cross section of that controlling weak spot, that controlling weak spot can be given a very small cross section without unduly weakening that embodiment. Similarly, because the portion of the second electrical conducting path of that embodiment, which is in register with the controlling weak spot in the first electrical conducting path of that embodiment, has a cross section which is larger than the cross section of that controlling weak spot, that controlling weak spot can be given a very small cross section without unduly weakening that embodiment. The mechanical strengths of the two electrical conducting paths in such an embodiment are additive; and they can make the total strength of the fusible element of that embodiment greater than the mechanical strength of a corresponding fusible element which has just one electrical conducting path and which provides the same current-carrying capacity.

The electrical conducting paths of the fusible element provided by the present invention are in electrical parallel relation, and hence the weak spots in those electrical conducting paths also are in electrical parallel relation. As a result, those weak spots can be given desirably small cross sections without unduly increasing the electrical resistance and heat generation of the fusible element. However, when those weak spots fuse, they cause the adjacent portions of the respective electrical conducting paths to fuse; and, thereupon each electrical conducting path has two series-arranged arcs therein. As a result, as the electric fuse opens the circuit, it provides the current-interrupting effect of series-arranged arcs. It is, therefore, an object of the present invention to provide a fusible element which has parallel-arranged weak spots that can have desirably-small cross sections without unduly increasing the electrical resistance and heat generation of that fusible element, and which provides the current-interrupting effect of series-arranged arcs as it opens the circuit.

Some embodiments of the fusible element provided by the present invention have terminals which define a plane, have a part of one of the electrical conducting paths thereof bent out of that plane in one direction, and have a part of the other of the electrical conducting paths thereof bent out of that plane in the opposite direction. The resulting displacement of those parts of those electrical conducting paths facilitates prompt current interruption by enabling those displaced parts to be fully immersed in displaced portions of arc-quenching filler and by providing a non-linear metallic path between those terminals. As a result, those embodiments of the fusible element provided by the present invention can quickly extinguish the arcs which form therein as they open the circuit; and yet no metal need be removed from that fusible element to effect the desired displacement of those parts of that fusible element. It is, therefore, an object of the present invention to provide a fusible element which has terminals that define a plane, which has a part of one of the electrical conducting paths thereof bent out of that plane in one direction, and which has a part of the other of the electrical conducting paths thereof bent out of that plane in the opposite direction.

Other and further objects and advantages of the present invention should become apparent from an examination of the drawing and accompanying description.

In the drawing and accompanying description many preferred embodiments of the present invention are shown and described but it is to be understood that the drawing and accompanying description are for the purpose of illustration only and do not limit the invention and that the invention will be defined by the appended claims.

DETAILED DESCRIPTION OF THE PREFERRED EMBODIMENTS

Figure 1:
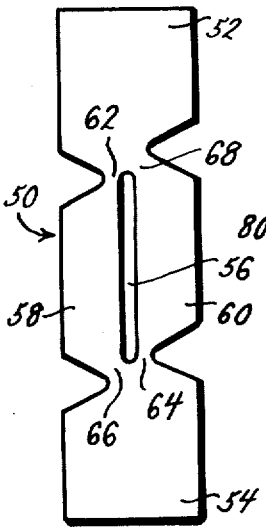
FIG. 1 is a plan view of one preferred embodiment of fusible element that is made in accordance with the principles and teachings of the present invention.

Referring to FIG. 1 in detail, the numeral 50 generally denotes a fusible element which is stamped or punched from a sheet of metal that has desirable current-interrupting properties. Such metals are silver, silver-copper alloys, copper, and copper-zinc alloys which have very high percentages of copper. One end of that fusible element constitutes a terminal 52, and the other end of that fusible element constitutes a terminal 54. An elongated slot 56 extends longitudinally of the fusible element 50, and the geometric center of that elongated slot is coincident with the geometric center of that fusible element. That elongated slot forces the current which flows from the terminal 52 to divide and to flow through two electrically conducting paths that are in electrical parallel relation. The main part of one of those electrical conducting paths is denoted by the numeral 58, and the main part of the other of those electrical conducting paths is denoted by the numeral 60. A weak spot 62 is defined by the upper end of the slot 56 and by a generally-triangular notch which extends inwardly from the left-hand edge of the fusible element 50. A similar weak spot 64 is defined by the lower end of the slot 56 and by a generally-triangular notch which extends inwardly from the right-hand edge of the fusible element 50. The numeral 66 denotes a wider weak spot which is defined by the lower end of the slot 56 and by a generally triangular notch which extends inwardly from the left-hand edge of the fusible element; and the numeral 68 denotes a similar weak spot which is defined by the upper end of the slot 56 and by a generally-triangular notch which extends inwardly from the right-hand edge of that fusible element. The cross section of the weak spot 68 is larger than the cross section of the weak spot 62; and the cross section of the former weak spot can be up to eight times the cross section of the latter weak spot. Similarly, the cross section of the weak spot 66 can be up to eight times the cross section of the weak spot 64.

The preferred ratio of the cross section of the weak spot 68 to the cross section of the weak spot 62 is three to one. Similarly, the preferred ratio of the cross section of the weak spot 66 to the cross section of the weak spot 64 is three to one.

The generally-triangular notches which help define the weak spots 62 and 64 have the apices thereof in general registry with the ends of the slot 56. However, the generally triangular notches which help define the weak spots 66 and 68 have the apices thereof displaced longitudinally outwardly beyond the ends of the slot 56. Such an arrangement is desirable because it enables the slot 56 to help define all of the weak spots 62, 64, 66 and 68 and yet provide a short metallic path between weak spots 62 and 68 and a short metallic path between weak spots 64 and 66. In addition, such an arrangement is desirable where solder is used to mechanically-secure and electrically-bond the terminals 52 and 54 to the terminals of an electric fuse; because that arrangement would make certain that none of that solder could flow to and affect the fusing action of either of the weak spots 62 and 64. If desired, however, the terminals 52 and 54 could be welded, brazed, or mechanically clamped to the terminals of an electric fuse.

The terminals 52 and 54 have the end faces thereof squared off to enable the fusible element 50 to be electrically bonded to the end-cap terminals of an electric fuse by "inside soldering." However, if either of those terminals is intended to pass through a slit in an end cap terminal of an electric fuse and to be electrically bonded to that end-cap terminal by "outside soldering," that terminal will be lengthened and will be given a generally semi-circular condiguration.

The upper end of the elongated slot 56 is close to, but does not interrupt, a straight-line metallic path which extends between the apices of the generally-triangular notches which define the weak spots 62 and 68. Similarly, the lower end of that elongated slot is close to, but does not interrupt, a straight-line metallic path which extends between the apices of the generally-triangular notches that help define the weak spots 64 and 66. As a result, the fusible element 50 has a straight metallic path which extends transversely of that fusible element, which extends between the apices of the generally triangular notches that define the weak spots 62 and 68, and which can constitute a burning path. Similarly, that fusible element has a straight metallic path which extends transversely of that fusible element, which extends between the apices of the generally-triangular notches that help define the weak spots 64 and 66, and which can constitute a burning path.

The weak spots 62 and 66 constitute portions of the left-hand electrical conducting path through the fusible element 50, and the weak spots 64 and 68 constitute portions of the right-hand electrical conducting path through that fusible element. The cross section of the weak spot 66 is less than one-half of the maximum cross section of the fusible element 50, and the cross section of the weak spot 64 is even smaller than the cross section of the weak spot 66. Similarly, the cross section of the weak spot 68 is less than one-half of the maximum cross section of the fusible element 50, and the cross section of the weak spot 62 is even smaller than the cross section of the weak spot 68. As a result, the current density in each of the weak spots 66 and 68 is greater than the current density in either of the terminals 52 and 54, and the current density in each of the weak spots 62 and 64 is greater than the current density in either of the weak spots 66 and 68.

One size of fusible element 50 is approximately two hundred and fifteen thousandths of an inch wide and is eight hundred and twenty-five thousandths of an inch long. The slot 56 is about thirty-two thousandths of an inch wide; and the distance between the centers of the semi-circles which define the ends of that slot is three-tenths of an inch. The straight-line distance between the mid-points of the weak spots 62 and 64 is approximately three hundred and three thousandths of an inch. Each of the four generally-triangular notches subtends about sixty degrees and has a radius of about one hundredth of an inch at its apex. The width of each of the weak spots 62 and 64 is eleven thousandths of an inch, and the width of each of the weak spots 66 and 68 is three times that width. Where the fusible element 50 is made of silver and has the foregoing dimensions, and where it is a part of an electric fuse that has a suitable casing, suitable terminals, and sand filler, it will have a rating of 35 amperes if its thickness is nine ten-thousandths of an inch; and it will have a rating of one hundred amperes if its thickness is five thousandths of an inch.

The cross section of each of the weak spots 62 and 64 is very small — being smaller than the cross section of most, and possibly all, weak spots of fusible elements that are produced on a large-volume production-line basis. As a result, each of the weak spots 62 and 64 is very fragile. However, the fusible element 50 is not fragile, and it can be produced on a large-volume production-line basis; because the weak spots 66 and 68 are, respectively, close to the weak spots 64 and 62, and hence help stiffen that fusible element. Because the cross sections of the weak spots 66 and 68 are larger than the cross sections of the weak spots 64 and 62, the stiffening effect provided by the weak spots 66 and 68 is substantial.

When current flows through the fusible element 50, one half of that current will flow successively from the terminal 52 through the weak spot 62, the main part 58 of the left-hand electrical conducting path, and the weak spot 66 to the terminal 54; while the other half of that current will flow successively from the terminal 52 through weak spot 68, the main part 60 of the right-hand electrical conducting path, and the weak spot 64 to the terminal 54. All portions of each of those electrical conducting paths will respond to the flow of current therethrough to generate heat; but each of the weak spots 62 and 64 will generate more heat per unit of length than will either of the weak spots 66 and 68, each of the latter weak spots will generate more heat per unit of length than will the main parts 58 and 60 of the two electrical conducting paths, and each of those main parts will generate more heat per unit of length than will either of the terminals 52 and 54. The terminal 52 and the main part 58 of the left-hand electrical conducting path will tend to absorb the heat which is generated by the weak spot 62. The terminal 52 will transfer some of that heat to the adjacent end-cap terminal, not shown, and will dissipate most of the rest of that heat to the surrounding air arc-extinguishing filler; and the main part 58 will dissipate most of the heat which is absorbs to the surrounding air or arc-extinguishing filler. Similarly, the terminal 54 and the main part 58 will tend to absorb and dissipate the heat which is generated by the weak spot 66. The terminal 52 and the main part 60 of the right-hand electrical conducting path will tend to absorb and dissipate the heat which is generated by the weak spot 68; and the terminal 54 and the main part 60 will tend to absorb and dissipate the heat which is generated by the weak spot 64.

Because the weak spots 62 and 64 have very small cross sections, the current densities in those weak spots can be quite high; and hence those weak spots will tend to generate sizable amounts of heat. However, as long as the current flowing through the fusible element 50 is equal to or less than the rating of that fusible element, all of the weak spots 62, 64, 66 and 68 will remain intact. Throughout the entire time those weak spots remain intact, the weak spots 62 and 64 will be in electrical parallel relation, the weak spots 66 and 68 will be in electrical parallel relation, and the main parts 58 and 60 of the two electrical conducting paths will be in electrical parallel relation. This means that the total resistance of the fusible element will be only one half of the resistance of either of those electrical conducting paths.

In the event a potentially-hurtful overcurrent develops, the weak spots 62 and 64 will generate heat at rates which are greater than the rates at which the adjacent portions of the fusible element 50 can absorb and dissipate that heat. If that potentially-hurtful overcurrent continues for a predetermined length of time, both of the weak spots 62 and 64 will fuse and form arcs. Those arcs will be displaced from each other by the width and length of the slot 56; but those arcs will be in electrical parallel relation with each other. As the weak spots 62 and 64 fuse, they will force the rate of rise of the overcurrent to start to diminish; and, because the cross sections of those weak sports are very small, those weak spots will force that rate of rise of the overcurrent to start to diminish at an unusually low level.

The arcs, which develop as the weak spots 62 and 64 fuse, will tend to burn the metal which is adjacent those weak spots; and that metal will burn in the longitudinal, as well as the transverse, direction. However, the thermal mass of the transversely-directed burning path, which extends between the apices of the generally-triangular notches that help define the weak spots 62 and 68, is less than one-half of the thermal mass of any path between the arcs which develop as the weak spots 62 and 64 fuse; and, similarly, the thermal mass of the transversely-directed burning path, which extends between the apices of the generally-triangular notches that help define the weak spots 64 and 66, is less than one-half of the thermal mass of any path between the arcs which develop as the weak spots 62 and 64 fuse. Consequently, before those arcs can burn far enough longitudinally of the fusible element 50 to merge and form a single elongated arc, those arcs will burn far enough transversely of that fusible element to reduce the cross sections of the wide spots 66 and 68 to values which will enable the current flowing through that fusible element to fuse those weak spots. The arc which will develop as the weak spot 66 fuses will be in series relation with the arc which developed as the weak spot 62 fused; and the arc which will develop as the weak spot 68 fuses will be in series relation with the arc which developed as the weak spot 64 fused. In addition, the arcs at the weak spots 62 and 68 will constitute a wide arc which is in series relation with a wide arc constituted by the arcs at the weak spots 64 and 66. As a result, only one-half of the voltage across the fusible element 50 will appear across the wide arc adjacent the weak spots 62 and 68; and, similarly, only one-half of that voltage will appear across the wide arc adjacent the weak spots 64 and 66. Consequently, the energy in the arc at each end of the fusible element 50 will be substantially less than the energy in an arc which develops at a single weak spot in a fusible element of comparable rating.

The larger cross sections of the weak spots 66 and 68 limit the rate at which the arcs at those weak spots can enlarge themselves sufficiently to effect opening of the circuit. Although the time, which the arcs at the weak spots 66 and 68 require to enlarge themselves sufficiently to effect opening of the circuit, is quite short — less than one hundred and twentieth of a second — it is long enough to enable the current to be reduced to zero at a rate which keeps potentially-hurtful inductive voltage surges from developing in the circuit. As a result, even though the fusible element 50 will make it possible for the electric fuse, in which it will be incorporated, to force the rate of rise of the overcurrent to start to diminish at a very low value, that fusible element will keep potentially-hurtful inductive voltage surges from developing.

The energy in the arcs, which develop as the weak spots of the fusible element 50 fuse, can be quickly absorbed by embedding that fusible element within suitable arc-extinguishing filler such as quartz sand. However, if desired, the fusible element 50 could be incorporated into an electric fuse which did not have arc-extinguishing filler therein.

Because the weak spots 62 and 64 will fuse before any other portions of the fusible element 50 can fuse, those weak spots are considered to be the controlling weak spots of that fusible element. Because the wide weak spots 66 and 68 fuse after portions thereof have been burned away by the arcs which develop as the weak spots 62 and 64 fuse, those wide weak spots are considered to be dependent weak spots. The controlling weak spot 62 has the dependent weak spot 66 in series relation with it, and has the dependent weak spot 68 generally in register with it. Similarly, the controlling weak spot 64 has the dependent weak spot 68 in series relation with it, and has the dependent weak spot 66 generally in register with it.

To make a fusible element that will operate in accordance with the principles and teachings of the present invention, it is only necessary to make the thermal mass of the transversely-directed burning path, between each controlling weak spot and its dependent weak spot, less than one half of the thermal mass of every longitudinally-extending potential burning path between adjacent controlling weak spots of that fusible element. To provide a factor of safety that will fully compensate for unavoidable manufacturing tolerances, for line voltage variations, for variations in circuit inductance, and for other conditions which could affect the operation of that fusible element, the thermal mass of each such transversely-directed burning path should be made appreciably smaller than one half of the thermal mass of every longitudinally-extending potential burning path between adjacent controlling weak spots of that fusible element.

In view of the principles and teachings of the present invention, those persons who are skilled in the art of electric fuses should have no difficulty in making a fusible element wherein the arcs which form as the controlling weak spots fuse will burn away enough of the dependent weak spots to enable those dependent weak spots to fuse before those arcs can burn far enough longitudinally of that fusible element to merge into one elongated, longitudinally extending arc. However, any person who was not skilled in the art of electric fuses could make a fusible element that would operate in accordance with the principles and teachings of the present invention by utilizing the following specific design criteria.

The current density in any given controlling weak spot of a fusible element can be represented by the notation $CD_C$, the current density in the adjacent dependent weak spot of that fusible element can be represented by the notation $CD_D$, and the current density in the maximum cross section portion of that fusible element can be represented by the notation $CD_{FE}$. The current density in that controlling weak spot must be greater than the current density in that dependent weak spot; and the current density in that dependent weak spot must be greater than the current density in that maximum cross section portion. Thus $$CD_C > CD_D > CD_{FE}$$

If, as is the case with the fusible element 50 of FIG. 1, the fusible element is planar, has a uniform thickness, has an elongated slot which helps define the parallel-arranged electrical conducting paths and weak spots of that fusible element, and has notches which help define those weak spots, the width of that elongated slot should be equal to or less than a fixed value. Specifically, if one end of that elongated slot stops short of, or merely extends to, a transversely directed line which extends between the controlling and dependent weak spots adjacent that one end, and if the other end of that elongated slot stops short of, or merely extends to, a transversely-directed line which extends between the controlling and dependent weak spots adjacent that other end, the width of that elongated slot should be equal to or less than one-quarter of an inch. However, if either end of that elongated slot extends beyond either of those transversely directed lines by a distance greater than twice the straight-line distance between the nearest portions of the notches which help define the controlling and dependent weak spots adjacent that end, the width of that elongated slot should be equal to or less than three thirty-seconds of an inch. Similarly, if a fusible element is constituted by two flat, metal strips, the transverse spacing between those flat, metal strips should be equal to or less than three thirty-seconds of an inch. Thus, if the width of an elongated slot which stops short of, or merely extends to, a transversely-extending line that extends between the controlling and dependent weak spots adjacent one end of that elongated slot is represented by the notation $W_A$:

$$W_A \leq \tfrac{1}{4} \text{ of an inch}$$

Alternatively, if the width of an elongated slot which extends beyond the transversely-extending line that extends between the controlling and dependent weak spots adjacent either end of that elongated slot is represented by the notation $W_B$, then $$W_B \leq 3/32 \text{ of an inch}$$

The dependent weak spot in any given fusible element must have a cross section which is greater than the cross section of the adjacent controlling weak spot in that fusible element; but the cross section of that dependent weak spot should not exceed eight times the cross section of that controlling weak spot multiplied by the ratio of the value of the current in that dependent weak spot to the value of the current in that controlling weak spot. Specifically, if the cross section of a given controlling weak spot of a fusible element is denoted as C, if the cross section of the adjacent dependent weak spot is denoted as D, if the value of the current flowing through that controlling weak spot is denoted as $I_C$, and if the value of the current flowing through that dependent weak spot is denoted as $I_D$, then $$D > C \text{ and}$$

$$D \leq 8\,C\left(\frac{I_D}{I_C}\right)$$

The amount of metal which must burn transversely of a fusible element, in response to an arc at a given controlling weak spot to enable the adjacent dependent weak spot to fuse, must be less than one-half of the amount of metal which must burn longitudinally of that fusible element to enable that arc to merge with the arc at the counterpart controlling weak spot. Specifically, if the amount of metal which must burn transversely of a fusible element, in response to an arc at a given controlling weak spot to enable the adjacent dependent weak spot to fuse, is denoted as $M_T$, which must burn longitudinally of that fusible element to enable that arc to merge with the arc at the counterpart controlling weak spot is denoted as $M_L$, then $$M_T < \frac{M_L}{2}$$

The wide arc which develops in the fusible element 50 of FIG. 1, as the arc at the dependent weak spot 68 forms and merges with the arc at the controlling weak spot 62, can be described as a controlling-dependent arc. Also, the wide arc which develops in that fusible element, as the arc at the dependent weak spot 66 forms and merges with the arc at the controlling weak spot 64, can be described as a controlling-dependent arc. Similarly, the wide arc which develops in any of the fusible elements of the present invention, as the arc at any of the dependent weak spots of that fusible element forms and merges with the arc at the adjacent controlling weak spot, can be described as a controlling-dependent arc. To operate in accordance with the principles and teachings of the present invention, a fusible element which has controlling weak spots and dependent weak spots therein must, where no controlling-dependent arc can merge into any other controlling-dependent arc, produce a number of controlling-dependent arcs which equals the number of controlling weak spots. Thus, if the number of separate and distinct controlling-dependent arcs that can form as a fusible element opens a circuit is denoted as $(C,D)_n$, and if the number of controlling weak spots in that fusible element is denoted as $n \cdot C$, then $$(C,D)_n = n \cdot C$$

The fusible element 50 of FIG. 1 meets all of these various design criteria. For example, the current density in the controlling weak spot 62 will be greater than the current density in the dependent weak spot 68; and, similarly, the current density in the controlling weak spot 64 will be greater than the current density in the dependent weak spot 66. The width of the slot 56 is thirty-two thousandths of an inch, and hence is less than one-quarter of an inch. The value of the current flowing through the controlling weak spot 62 will be equal to the value of the current flowing through the dependent weak spot 68, and the value of the current flowing through the controlling weak spot 64 will be equal to the value of the current flowing through the dependent weak spot 66; and hence $(I_D/I_C) = 1$. Consequently, because the cross-section of each of the dependent weak spots 66 and 68 is three times the cross-section of either of the controlling weak spots 62 and 64, $D \leqq 8C\,(I_D/I_C)$. The amount of metal which must burn transversely of the fusible element 50, in response to an arc at either of the controlling weak spots 62 and 64 to enable the adjacent dependent weak spot to fuse, is less than one-half of the amount of metal which must burn longitudinally of that fusible element to enable that arc to merge with the arc at the other of those controlling weak spots. Consequently, in that fusible element $M_T < (M_L/2)$. Additionally, the fusible element 50 will develop two series-arranged, spaced-apart, controlling-dependent arcs as it fuses; and hence $(C,D)_n = n \cdot C$.

Figure 2:
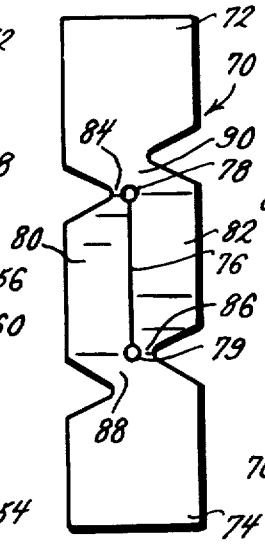
FIG. 2 is a plan view of a second preferred embodiment of fusible element.
Figure 3:
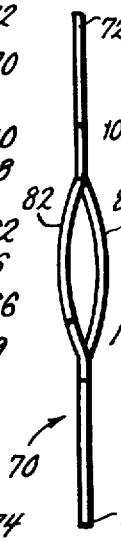
FIG. 3 is a side elevational view of the fusible element of FIG. 2, FIGS. 4 - 14 are plan views of further preferred embodiments of fusible elements.

Referring to FIGS. 2 and 3, the numeral 70 generally denotes a fusible element wherein one end serves as a terminal 72 and wherein the other end thereof serves as a terminal 74. A slit 76 extends axially of that fusible element; and the geometric center of that slit is coincident with the geometric center of that fusible element. Small holes 78 and 79 define the ends of that slit. That slit forces the current flowing through the fusible element 70 to divide between two electrical conducting paths which are in parallel relation. The numeral 80 denotes the main part of the left-hand electrical conducting path, and the numeral 82 denotes the main part of the right-hand electrical conducting path. The numeral 84 denotes a controlling weak spot which is defined by the small hole 78 and by a generally-triangular notch which extends inwardly from the left-hand edge of the fusible element 70. The numeral 86 denotes a controlling weak spot which has the same length and cross section as the weak spot 84 and which is defined by the small hole 79 and by a generally-triangular notch which extends inwardly from the right-hand edge of the fusible element 70. The numeral 88 denotes a dependent weak spot which is defined by the small hole 79 and by a generally triangular notch which extends inwardly from the left-hand edge of the fusible element 70. The numeral 88 denotes a dependent weak spot which is defined by the small hole 79 and by a generally triangular notch which extends inwardly from the left-hand edge of the fusible element 70; and the numeral 90 denotes a dependent weak spot which has the same length and cross section as the weak spot 88 and which is defined by the small hole 78 and by a generally triangular notch which extends inwardly from the right-hand edge of that fusible element.

The terminals 72 and 74 define a plane, as shown particularly by FIG. 3; and the main part 80 of the left-hand electrical conducting path is bowed downwardly from that plane, while the main part 82 of the right-hand electrical conducting path is bowed upwardly from that plane, all as shown particularly by FIG. 3. As a result, the main parts 80 and 82 of the left-hand and right-hand electrical conducting paths, respectfully, are physically separated by the slot 76 and also by the oppositely-directed bowing of those main parts.

The fusible element 70 can have the same thickness, width and length as the fusible element 50. Further, the notches which help define the weak spots in the fusible element 70 can subtend the same angles which are subtended by the notches that help define the weak spots in the fusible element 50. Additionally, the weak spots 84 and 86 can have the same widths as the weak spot 62 and 64 of the fusible element 50, and the weak spots 88 and 90 can have the same widths as the weak spots 66 and 68 of the fusible element 50. In one size of the fusible element 70, the small holes 78 and 79 have diameters of twenty-four thousandths of an inch. The length of the slit 76 is the same as the length of the slot 56 in FIG. 1; but that slit is shown as being shorter because of the bowing of the main parts 80 and 82. The main part 80 of the left-hand electrical conducting path is bowed about sixty-five thousandths of an inch downwardly from the plane defined by the terminals 72 and 74; while the main part 82 of the right-hand electrical conducting path is bowed upwardly from that plane that same distance.

The fusible element 70 will provide current-carrying and current-interrupting characteristics that are effectively the same as the current-carrying and current-interrupting characteristics provided by the fusible element 50. The controlling weak spots 84 and 86 are in electrical parallel relation as along as they remain intact; and hence the total resistance of those weak spots is only one half of the effective resistance of either of those weak spots. Importantly, those controlling weak spots establish low values at which the rate of rise of the overcurrent must begin to diminish when the fusible element 70 responds to a potentially-hurtful overcurrent to cause those weak spots to fuse. Furthermore, the arcs which develop as the controlling weak spots 84 and 86 fuse will quickly reduce the cross sections of the dependent weak spots 88 and 90 to the points where those dependent weak spots also will fuse; and, at that time the fusible element 70 will have two wide series-arranged arcs. As a result, the fusible element 70, like the fusible element 50, can start diminishing the rate of rise of the overcurrent at very low levels, and yet can provide the desirable current-interrupting characteristics which the series-arranged weak spots of a fusible element can provide when they fuse simultaneously.

Figure 4:
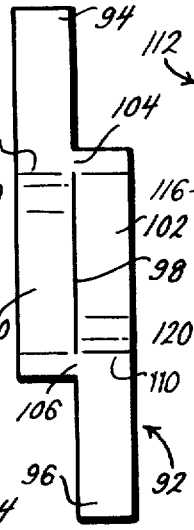

Referring to FIG. 4, the numeral 92 generally denotes a third fusible element which is made in accordance with the principles and teachings of the present invention. One end of that fusible element serves as a terminal 94 while the opposite end of that fusible element serves as a terminal 96. A slit 98 extends axially of the fusible element 92; and the geometric center of that slit is coincident with the geometric center of that fusible element. If desired, small holes such as the small holes 78 and 79 could be provided at the ends of the slit 98.

That slit forces the current flowing through the fusible element 92 to pass through two separate electrical conducting paths which are in electrical parallel relation. The numeral 100 denotes the main part of the left-hand electrical conducting path while the numeral 102 denotes the main part of the right-hand electrical conducting path. The terminals 94 and 96 of the fusible element 92 define a plane; and the main parts 100 and 102 of the left-hand and right-hand electrical conducting paths are bowed in opposite directions from that plane — in the same manner in which the main parts 80 and 82 are bowed out of the plane defined by the terminals 72 and 74 in FIGS. 2 and 3. The numeral 104 denotes a controlling weak spot which is defined by the upper end of the slit 98 and by a rectangular notch that defines the upper right-hand corner of the fusible element 92; and the numeral 106 denotes a controlling weak spot of the same size which is defined by the lower end of that slit and by a rectangular notch that defines the lower left-hand corner of that fusible element. The numeral 108 denotes a dependent weak spot which is defined by the upper end of the slit 98 and by the left-hand edge of the fusible element 92; and the numeral 110 denotes a similar dependent weak spot which is defined by the lower end of that slit and by the right-hand edge of that fusible element.

The current carrying and current-interrupting characteristics of the fusible element 92 will be comparable to the current-carrying and current-interrupting characteristics of the fusible element 70 of FIGS. 2 and 3. Specifically, the controlling weak spots 104 and 106 will be in parallel relation as long as they remain intact; and the total resistance of those weak spots is only one half of the effective resistance of either of those weak spots. Importantly, those controlling weak spots establish low values at which the rate of rise of the overcurrent must begin to diminish when the fusible element 92 responds to an overcurrent to cause those weak spots to fuse. Furthermore, the arcs which develop as the controlling weak spots 104 and 106 fuse will quickly reduce the cross sections of the dependent weak spots 108 and 110 to the points where those dependent weak spots also will fuse; and, at that time, the fusible element 92 will have two wide series-arranged arcs. As a result, the fusible element 92, like the fusible element 50, can start diminishing the rate of rise of the overcurrent at very low levels, and yet can provide the desirable current-interrupting characteristics which the series-arranged weak spots of a fusible element can provide when they fuse simultaneously.

Figure 5:
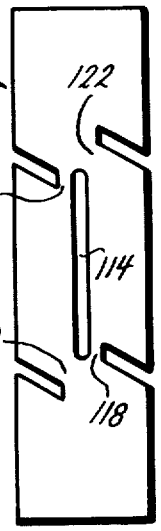

Referring to FIG. 5, the numeral 112 generally denotes another preferred embodiment of fusible element; and the opposite ends of that fusible element will serve as terminals. The numeral 114 denotes a slot which extends axially of that fusible element; and the geometric center of that slot is coincident with the geometric center of that fusible element. The numerals 116 and 118 denote controlling weak spots which are defined by the opposite ends of the slot 114 and by rhombic notches which extend inwardly from the edges of that fusible element. The numerals 120 and 122 denote dependent weak spots which are defined by the opposite ends of the slot 114 and by rhombic notches which extend inwardly from the edges of that fusible element. The current-carrying and current-interrupting characteristics of the fusible element 112 will be comparable to the current-carrying and current-interrupting characteristics of the fusible element 50 of FIG. 1.

Figure 6:
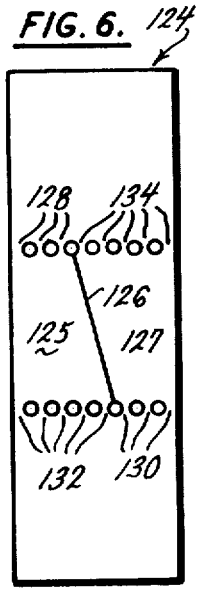

Referring to FIG. 6, the numeral 124 generally denotes a fusible element which has a slit 126 therein. That slit differs from the slits 76 and 98, respectively, of the fusible elements 70 and 92, in that it does not extend axially of the fusible element 124. Instead, that slit is inclined at a shallow angle to the axis of that fusible element. The slit 126 forces the current flowing through the fusible element 124 to flow through two electrical conducting paths; and the main part of the left-hand electrical conducting path is denoted by the numeral 125, while the main part of the right-hand electrical conducting path is denoted by the numeral 127. The numeral 128 denotes three narrow areas which are defined by small-diameter openings; and one of those openings de-limits the upper end of the slit 126. The numeral 130 denotes three narrow areas which are defined by small-diameter openings, and one of those openings de-limits the lower end of the slit 126. The numeral 132 denotes five narrow areas which are defined by small-diameter openings, and one of those openings is the opening which de-limits the lower end of the slit 126. The numeral 134 denotes five narrow areas which are defined by small-diameter openings, and one of those openings in the opening which delimits the upper end of the slit 126. The narrow areas 128 constitute a controlling weak spot which is comparable to the controlling weak spot 84 of the fusible element 70; and the narrow areas 130 constitute a controlling weak spot which is comparable to the controlling weak spot 86 of that fusible element. The narrow areas 132 constitute a dependent weak spot which is comparable to the dependent weak spot 88 of the fusible element 70; and the narrow areas 134 constitute a dependent weak spot which is comparable to the dependent weak spot 90 of that fusible element. The ends of the fusible element 124 serve as terminals; and those ends define a plane. The main part 125 of the left-hand electrical conducting path is bowed out of that plane in one direction, while the main part 127 of the right-hand electrical conducting path is bowed out of that plane in the opposite direction.

All of the narrow areas 128, 130, 132 and 134 will remain intact as long as the current flowing through the fusible element 124 is at or below the rated current of that fusible element. However, if a potentially-hurtful overcurrent develops and continues for a predetermined length of time, the narrow areas 128 and 130 will fuse and permit arcs to form. The fusing of those narrow areas will force the rate of rise of the overcurrent to start to diminish; and the arcs which develop as those narrow areas fuse will start to burn away some of the narrow areas 132 and 134. When enough of the narrow areas 132 and 134 have been burned away to enable the remaining narrow areas 132 and 134 to fuse, the arcs adjacent the opposite ends of the slit 126 will constitute two wide series-arranged arcs; and, thereupon, the fusible element 124 will provide the desirable current-interrupting characteristics of a fusible element which has two series-connected weak spots that fuse simultaneously.

Figure 7:
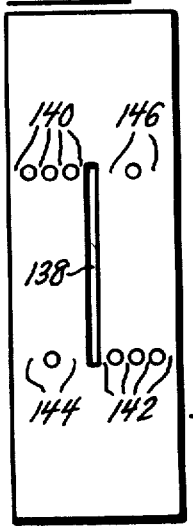

Referring to FIG. 7, the numeral 136 generally denotes a fusible element which has an elongated axially extending slot 138 therein. The geometric center of that slot is coincident with the geometric center of that fusible element. The numeral 140 denotes four narrow areas which are defined by small-diameter openings and by the upper end of the slot 138; and the numeral 142 denotes four narrow areas which are defined by small-diameter openings and by the lower end of that slot. The numeral 144 denotes two wider areas which are defined by a small-diameter opening and by the lower end of the slot 138; and the numeral 146 denotes two areas which are defined by a small-diameter opening and by the upper end of that slot. The narrow areas 140 constitute a controlling weak spot which is generally comparable to the controlling weak spot 62 of the fusible element 50, and the narrow areas 142 constitute a controlling weak spot which is generally comparable to the controlling weak spot 64 of that fusible element. The wider areas 144 constitute a dependent weak spot which is generally comparable to the dependent weak spot 66 of the fusible element 50, and the areas 146 constitute a dependent weak spot which is generally comparable to the dependent weak spot 68 of that fusible element.

The current-carrying and current-interrupting characteristics of the fusible element 136 will be generally comparable to those of the fusible element 50. Specifically, all of the narrow areas 140, 142, 144 and 146 will remain intact as long as the current flowing through the fusible element 136 is equal to or less than the rated current of that fusible element. However, in the event a potentially hurtful overcurrent develops and continues for a predetermined length of time, the narrow areas 140 and 142 will fuse and will thereby force the rate of rise of the overcurrent to start to diminish. The arcs which form as those narrow areas fuse will start to burn away some of the adjacent wider areas 146 and 144; and, as soon as the effective widths of the areas 144 and 146 are small enough to fuse, the fusible element 136 will have two wide series-arranged arcs therein. Consequently, although that fusible element will have the low resistance of parallel-connected weak spots and although it will be able to force the rate of rise of the overcurrent to start to diminish at a low value, that fusible element will be able to provide the desirable current-interrupting characteristics of a fusible element which has series-connected weak spots therein that fuse simultaneously.

Figure 8:
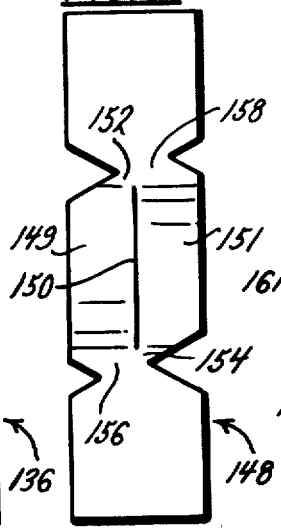

Referring to FIG. 8, the numeral 148 generally denotes a fusible element which has an elongated slit 150 that forces the current flowing through the fusible element to pass through two electrically conducting paths. The numeral 149 denotes the bowed main part of the left-hand electrical conducting path, and the numeral 151 denotes the oppositely-bowed main part of the right-hand electrical conducting path. The numeral 152 denotes a controlling weak spot which is defined by the upper end of the slit 150 and by a triangular notch that extends inwardly from the left-hand edge of the fusible element 148; and the numeral 154 denotes a controlling weak spot of the same width which is defined by the lower end of that slit and by a triangular notch that extends inwardly from the right-hand edge of that fusible element. The numeral 156 denotes a dependent weak spot which is defined by the lower end of the slit 150 and by a triangular notch that extends inwardly from the left-hand edge of the fusible element 148; and the numeral 158 denotes a dependent weak spot of the same width which is defined by the upper end of that slit and by a triangular notch that extends inwardly from the right-hand edge of that fusible element.

The fusible element 148 differs primarily from the fusible element 70 of FIGS. 2 and 3 in that the ends of the slit 150 are displaced axially inwardly of the apices of the notches which define the controlling weak spots 152 and 154. The fusible element 148 also differs from the fusible element 70 in that holes are not used to delimit the ends of the slit 150, and the inner ends of the notches are not rounded. However, the current-carrying and current-interrupting characterisitics of the fusible element 148 are generally comparable to those of the fusible element 70.

Figure 9:
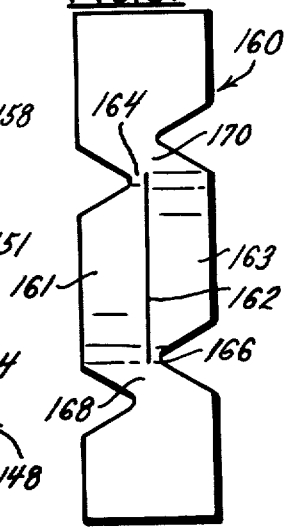

Referring to FIG. 9, the numeral 160 generally denotes a fusible element which has a slit 162 that forces the current to flow through two electrically conducting paths that are in electrical parallel relation. The numeral 161 denotes the bowed main part of the left-hand electrical conducting path, while the numeral 163 denotes the oppositely bowed main part of the right-hand electrical conducting path. The numerals 164 and 166 denote controlling weak spots which are defined by the opposite ends of the slit 162 and by the inner ends of generally-triangular notches that extend inwardly from the edge of the fusible element 160. The numerals 168 and 170 denote dependent weak spots which are defined by the opposite ends of the slit 162 and by generally-triangular notches which extend inwardly from the edge of the fusible element 160.

The fusible element 160 differs primarily from the fusible element 70 of FIGS. 2 and 3 in eliminating the small holes 78 and 79 which de-limit the slit 76 of the latter fusible element. However, the current-carrying and current-interrupting characteristics of the fusible element 160 will be very similar to those of the fusible element 70.

Figure 10:
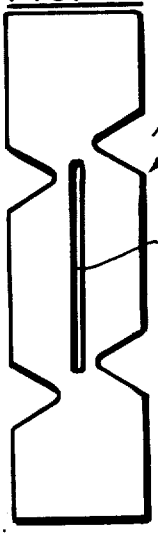

Referring to FIG. 10, the numeral 172 generally denotes a fusible element which has an elongated slot 174 therein. That slot coacts with generally-triangular notches which extend inwardly from the edges of that fusible element to define two small cross-section controlling weak spots and two larger cross-section dependent weak spots. The fusible element 172 differs primarily from the fusible element 50 of FIG. 1 in having the ends of the slot 174 defined by straight lines rather than by arcs, and in having that slot narrower than the slot 56. However, the current-carrying and current-interrupting characteristics of the fusible element 172 can be very similar to those of the fusible element 50.

Figure 11:
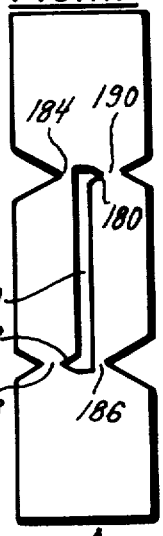

Referring to FIG. 11, the numeral 176 generally denotes a fusible element which has an elongated slot 178 therein. An offset 180 of triangular configuration is provided adjacent the upper end of the slot 178, and an offset 182 of triangular configuration is provided adjacent the lower end of that slot. The numeral 184 denotes a controlling weak spot which is defined by the upper end of the left-hand edge of the slot 178 and by the apex of a triangular notch which extends inwardly from the left-hand edge of the fusible element 176. The numeral 186 denotes a similar controlling weak spot which is defined by the lower end of the right-hand edge of the slot 178 and by a triangular notch which extends inwardly from the right-hand edge of that fusible element. The numeral 188 denotes a dependent weak spot which is defined by the offset 182 and by the apex of a notch which extends inwardly from the left-hand edge of the fusible element 176; and the numeral 190 denotes a similar dependent weak spot which is defined by the offset 180 and by the apex of a triangular notch which extends inwardly from the right-hand edge of that fusible element.

The fusible element 176 differs primarily from the fusible element 50 of FIG. 1 in having the offsets 180 and 182 at the ends of the slot 178. That fusible element also differs from the fusible element 50 in having the controlling and dependent weak spots directly opposite each other, and in having pointed apices for the notches which help define the weak spots. However, the current-carrying and current-interrupting characteristics of the fusible element 176 can be similar to those of the fusible element 50.

Figure 12:
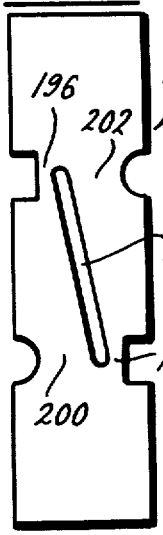

Referring to FIG. 12, the numeral 192 generally denotes a fusible element which has an elongated slot 194 therein. The numeral 196 denotes a controlling weak spot which is defined by the upper end of that slot and by a rectangular notch which extends inwardly from the left-hand edge of the fusible element 192. The numeral 198 denotes a similar controlling weak spot adjacent the lower end of that slot. The numeral 200 denotes a dependent weak spot which is defined by the lower end of the slot 194 and by a semi-circular notch which extends inwardly from the left-hand edge of the fusible element 192; and the numeral 202 denotes a similar dependent weak spot adjacent the upper end of that slot. The fusible element 192 differs primarily from the fusible element 50 of FIG. 1 in that the slot 194 is inclined to the axis of that fusible element 192, in the configurations of the notches which define the weak spots, and in the positioning of those notches directly opposite each other. However, the current-carrying and current-interrupting characteristics of the fusible element 192 can be generally comparable to those of the fusible element 50.

Figure 13:
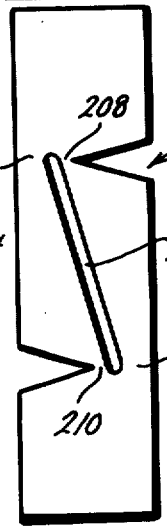

Referring to FIG. 13, the numeral 204 generally denotes a fusible element which has an elongated slot 206 therein. The numeral 208 denotes a controlling weak spot which is defined by the upper end of that slot and by a triangular notch which extends inwardly from the right-hand end edge of the fusible element 204. The numeral 210 denotes a similar controlling weak spot which is defined by the lower end of that slot and by a triangular notch which extends inwardly from the left-hand edge of that fusible element. The numeral 212 denotes a dependent weak spot which is defined by the upper end of the slot 206 and by the left-hand edge of the fusible element 204; and the numeral 214 denotes a similar dependent weak spot adjacent the lower end of that slot. The fusible element 204 differs primarily from the fusible element 50 of FIG. 1 in that the elongated slot 206 is inclined to the axis of the fusible element 204, in the configurations of the notches which help define the controlling weak spots 208 and 210, and in that the edges of that fusible element help define the dependent weak spots 212 and 214. However, the current-carrying and current-interrupting characteristics of the fusible element 204 can be generally comparable to those of the fusible element 50.

Figure 14:
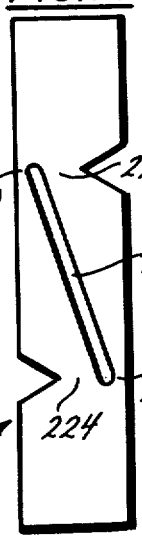

Referring to FIG. 14, the numeral 216 generally denotes a fusible element which has an elongated slot 218 therein. The numeral 220 denotes a controlling weak spot which is defined by the upper end of that elongated slot and by the left-hand edge of the fusible element 216; and the numeral 222 denotes a similar controlling weak spot adjacent the lower end of that slot. The numeral 224 denotes a dependent weak spot which is defined by the lower end of the slot 218 and by the apex of a triangular notch which extends inwardly from the left-hand edge of the fusible element 216; and the numeral 226 denotes a similar weak spot adjacent the upper end of that slot. The fusible element 216 differs primarily from the fusible element 50 of FIG. 1 in that the elongated slot 218 is inclined to the axis of the fusible element 216, in the configurations of the notches which help define the dependent weak spots 224 226, and in that the edges of that fusible element help define the controlling weak spots 220 and 222.

Figure 15:
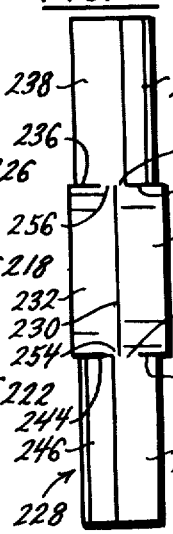
FIG. 15 is a plan view of an additional preferred embodiment of fusible element.
Figure 16:
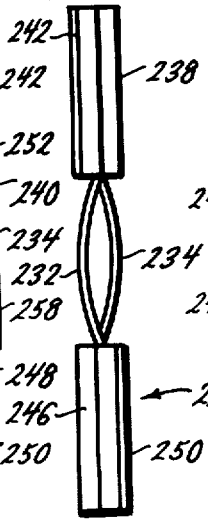
FIG. 16 is a side elevational view of the fusible element of FIG. 15.
Figure 17:
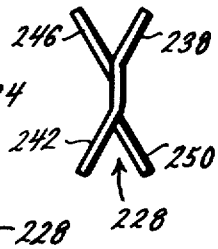
FIG. 17 is an end elevational view, on a larger scale, of the fusible element of FIG. 15, FIGS. 18 - 20 are plan views of other preferred embodiments of fusible elements.

Referring to FIGS. 15 – 17, the numeral 228 generally denotes a fusible element which has an elongated slit 230 therein. That slit forces the current flowing through that fusible element to move through two electrical conducting paths which are in parallel electrical relation; and the main part of the left-hand electrical conducting path is denoted by the numeral 232 while the main part of the right-hand electrical conducting path is denoted by the numeral 234. The numeral 236 denotes a slit which extends inwardly from the left-hand edge of the fusible element 228 and which is in register with the upper end of the slit 230; and the portion of the upper end of the fusible element 228 which is in register with the slit 236 is denoted by the numeral 238 and is bent downwardly relative to the plane defined by the central portion of that upper end. The numeral 240 denotes a slit which extends inwardly from the right-hand edge of the fusible element 228 and which is aligned with the slit 236, and thus is in register with the upper end of the slit 230. The portion of the upper end of the fusible element 228 which is in register with the slit 240 is denoted by the numeral 242 and is bent upwardly relative to the plane defined by the central portion of that upper end. The numeral 244 denotes a slit which extends inwardly from the left-hand edge of the fusible element 228 and which is in register with the lower end of the slit 230. The portion of the lower end of the fusible element 228 which is in register with the slit 244 is denoted by the numeral 246 and is bent upwardly relative to the plane defined by the central portion of that lower end. The numeral 248 denotes a slit which extends inwardly from the right-hand end edge of the fusible element 228 and which is aligned with the slit 244, and thus is in register with the lower end of the slit 230. The portion of the lower end of the fusible element 228 which is in register with the slit 248 is denoted by the numeral 250 and is bent downwardly relative to the plane defined by the central portion of that lower end.

The numeral 252 denotes a controlling weak spot which is defined by the upper end of the slit 230 and by the inner end of the slit 240; and the numeral 254 denotes a similar controlling weak spot which is defined by the lower end of the slit 230 and by the inner end of the slit 244. The numeral 256 denotes a dependent weak spot which is defined by the upper end of the slit 230 and by the inner end of the slit 236; and the numeral 258 denotes a similar dependent weak spot which is defined by the lower end of the slit 230 and by the inner end of the slit 248. The weak spots 252, 254, 256 and 258 are considered to be zero-length weak spots because no part of the metal of the fusible element 228 need be removed to form these weak spots.

The downward bending of the portion 238 coacts with the slit 236 to force current to flow through the dependent weak spot 256, the upward bending of the portion 242 coacts with the slit 240 to force current to flow through the controlling weak spot 252, the upward bending of the portion 246 coacts with the slit 244 to force current to flow through the controlling weak spot 254, and the downward bending of the portion 250 coacts with the slit 248 to force current to flow through the dependent weak spot 258. Until the current reaches the weak spots 252 and 256, that current can distribute itself across the full width of the upper end of the fusible element 228; and, after that current moves downwardly past the weak spots 254 and 258, it can again distribute itself across the full width of that fusible element. Moreover, as the current which flows through the main part 232 of the left-hand electrical conducting path 232 moves downwardly past the weak spot 256, it can distribute itself across the full width of that main part; and, similarly, as the current which flows through the main part 234 of the right-hand electrical conducting path moves downwardly past the weak spot 252, it can distribute itself across the full width of that main part. Consequently, the total resistance of the fusible element 228 is close to that of a similar piece of metal which does not have any slits therein. The main parts 232 and 234 are bowed in opposite directions, as shown by FIG. 16.

As long as the current flowing through the fusible element 228 is equal to or less than the rated current of that fusible element, all of the weak spots 252, 254, 256 and 258 will remain intact. Throughout the entire time those weak spots remain intact, the controlling weak spots 252 and 254 will be in electrical parallel relation, the dependent weak spots 256 and 258 will be in electrical parallel relation, and the main parts of the electrical conducting paths will be in electrical parallel relation. If a potentially hurtful overcurrent develops and continues for a predetermined length of time, the controlling weak spots 252 and 254 will fuse, and will thereby force the rate of rise of the overcurrent to start to diminish. The arcs which form as the weak spots 252 and 254 fuse will start to burn into the dependent weak spots 256 and 258; and, as soon as enough of those dependent weak spots have burned away to enable those weak spots to fuse, wide arcs will develop at the opposite ends of the slit 230 which will act as series-arranged arcs. Consequently, although the appearance of the fusible element 228 is considerably different from that of the fusible element 70 of FIGS. 2 and 3, the current-carrying and current-interrupting characteristics of the fusible element 228 can be generally comparable to those of the fusible element 70.

Figure 18:
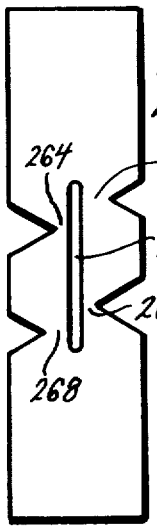

Referring to FIG. 18, the numeral 260 generally denotes a fusible element which has an elongated slot 262 therein. Controlling weak spots 264 and 266 are defined by that slot and by triangular notches which extend inwardly from the opposite edges of the fusible element 260. Dependent weak spots 268 and 270 are defined by the slot 262 and by triangular notches which extend inwardly from the opposite edges of that fusible element.

The fusible element 260 differs primarily from the fusible element 50 of FIG. 1 in that the ends of the slot 262 extend considerable distances axially beyond the controlling weak spot 264 and 266. As a result that slot constitutes a part of the burning path from the controlling weak spot 264 to the dependent weak spot 270, and also constitutes a part of the burning path from the controlling weak spot 266 to the dependent weak spot 268. If the fusible element 260 is immersed within arc-extinguishing filler, the slot 262 will have arc-extinguishing filler therein; and hence the slot 262 and the arc-extinguishing filler therein will impede the rate at which the arcs which develop at the controlling weak spots 264 and 266 can burn into the dependent weak spots 268 and 270. However, where the slot 262 has a width of three thirty-seconds of an inch or less, the arcs which form when the controlling weak spots 264 and 266 fuse can burn far enough into the dependent weak spots 268 and 270 to cause those dependent weak spots to fuse. As a result, the fusible element 260 can have current-carrying and current-interrupting characteristics which are generally comparable to those of the fusible element 50 of FIG. 1.

Figure 19:
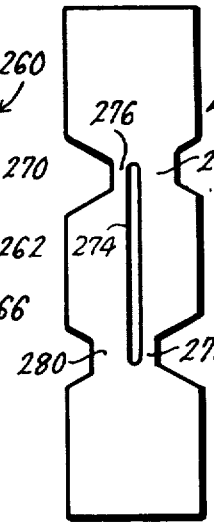

Referring to FIG. 19, the numeral 272 denotes a fusible element which has an elongated slot 274 therein; and the opposite ends of that slot coact with frusto-triangular notches that extend inwardly from the opposite edges of that fusible element to define controlling weak spots 276 and 278. The opposite ends of that slot also coact with further frusto-triangular notches to define dependent weak spots 280 and 282. The fusible element 272 differs primarily from the fusible element 50 of FIG. 1 in the lengths and configurations of the weak spots. However, the fusible element 272 can have current-carrying and current-interrupting characteristics which are comparable to those of the fusible element 50.

Figure 20:
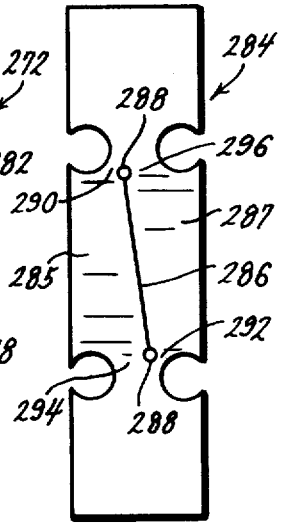

Referring to FIG. 20, the numeral 284 generally denotes a fusible element which has an elongated slit 286 therein. That slit forces the current flowing through that fusible element to pass through two electrical conducting paths; and the main part of the left-hand electrical conducting path is denoted by the numeral 285, while the main part of the right-hand electrical conducting path is denoted by the numeral 287. Those main parts will be bowed in opposite directions from the plane which is defined by the ends of the fusible element 284.

Small holes 288 de-limit the ends of the slit 286; and the hole 288 at the upper end of that slit coacts with a circular notch which extends inwardly from the left-hand edge of the fusible element 284 to define a controlling weak spot 290. The hole 288 at the lower end of the slit 288 coacts with a circular notch which extends inwardly from the right-hand edge of the fusible element 284 to define a similar controlling weak spot 292. The small holes 288 coact with further circular notches that extend inwardly from the opposite edges of the fusible element 284 to define dependent weak spots 294 and 296.

The fusible element 284 differs primarily from the fusible element 70 of FIGS. 2 and 3 in that the slit 286 is inclined to the axis of that fusible element, and in that the notches which help define the weak spots are circular in configuration. However, the current-carrying and current-interrupting characteristics of the fusible element 284 can be comparable to those of the fusible element 70.

Figure 21:
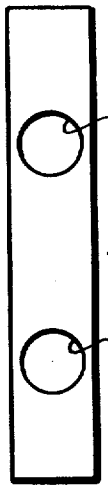
FIG. 21 is a plan view of a barrier of insulating material.
Figure 22:
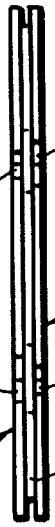
FIG. 22 is a side view of the barrier of FIG. 21 and of metal strips which are in face-to-face engagement with the broad faces of that barrier.
Figure 23:
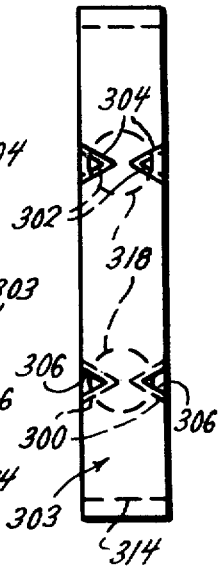
FIG. 23 is a plan view of the fusible element constituted by the barrier of FIGS. 21 and 22 and by the metal strips of FIG. 22.

Referring to FIGS. 21 - 23, the numeral 298 generally denotes a metal strip which has triangular notches 300 that are in register with each other and that extend inwardly from the opposite edges of that metal strip to define a controlling weak spot. That metal strip also has smaller triangular notches 302 that are in register with each other and that extend inwardly from the opposite edges of that metal strip to define a dependent weak spot. The numeral 303 generally denotes a metal strip which is identical to the metal strip 298 but which is rotated end for end from the position occupied by the metal strip 298. The metal strip 303 has triangular notches 304 that are in register with each other and that extend inwardly from the opposite edges of that metal strip to define a controlling weak spot; and that weak spot is in confronting relation with the dependent weak spot of the metal strip 298. The metal strip 303 also has smaller triangular notches 306 that are in register with each other and that extend inwardly from the opposite edges of that metal strip to define a dependent weak spot; and that weak spot is in confronting relation with the controlling weak spot of the metal strip 298.

The numeral 314 denotes a thin plate of insulating material which is as wide as each of the metal strips 298 and 303 but which is shorter than either of those metal strips. That plate has a large hole 316 therein which is in register with the peak spots that are defined by the notches 302 and 304, respectively, in the metal strips 298 and 303. The plate 314 also has a large hole 318 therein which is in register with the weak spots that are defined by the notches 300 and 306, respectively, in the metal strips 298 and 303. The ends of those metal strips will be suitably soldered to the inner surfaces of the end-cap terminals of an electric fuse; and, when so soldered, those metal strips will constitute a fusible element.

The plate 314 of insulating material will act as a barrier between the confronting faces of the metal strips 298 and 303, and hence will force the current flowing through the fusible element to divide; one-half of that current flowing through the metal strip 298, and the other half of that current flowing through the metal strip 303. As long as that current is equal to or less than the rated current of that fusible element, all of the weak spots of the metal strips 298 and 303 will remain intact; and hence that fusible element will have the low resistance of a fusible element which has parallel-connected weak spots.

If a potentially-hurtful overcurrent develops and continues for a predetermined length of time, the controlling weak spot defined by the notches 304 in the metal strip weak spot defined by the notches 304 in the metal strip 303 and the controlling weak spot defined by the notches 300 in the metal strip 298 will fuse, and will thereby force the rate of rise of the overcurrent to start to diminish. In addition the arcs, which develop as those weak spots fuse, will enter the openings 316 and 318 in the plate 314 of insulating material and will start to burn the dependent weak spots which are defined by the notches 302 and 306, respectively, in the metal strips 298 and 303. As soon as the arcs from the controlling weak spots have burned away enough of the dependent weak spots to enable the latter weak spots to fuse, the fusible element will have a wide arc at each of the openings 316 and 318 in the plate 314; and those wide arcs will provide the current-interrupting action of the two series-arranged arcs. As a result, the metal strips 298 and 303 can coact to provide current-carrying and current-interrupting characteristics which are generally comparable to those of the fusible element 50 of FIG. 1. To make certain that the arcs, which develop as the controlling weak spots of the metal strips 298 and 303 fuse, will start to burn the dependent weak spots of those metal strips, the plate 314 of insulating material should have a thickness no greater than three thirty-seconds of an inch.

If desired, the plate 314 of insulating material could be eliminated, and the confronting faces of the metal strips 298 and 303 could be insulated from each other by air or by arc-extinguishing filler. In either of the latter events, the spacing between the confronting faces of those metal strips should not exceed three thirty-seconds of an inch.

Figure 24:
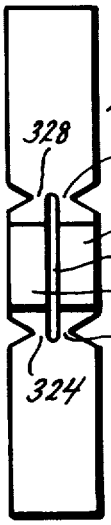
FIG. 24 is a plan view of a preferred embodiment of fusible element which has heat-absorbing plates thereon.
Figure 25:
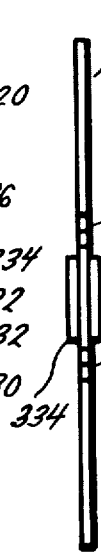
FIG. 25 is a side view of the fusible element of FIG. 24.

Referring to FIGS. 24 and 25, the numeral 320 generally denotes a fusible element which has an elongated slot 322 therein. The numeral 324 denotes a controlling weak spot which is defined by the lower end of that slot and by a triangular notch which extends inwardly from the left-hand edge of the fusible element 320; and the numeral 326 denotes a similar controlling weak spot adjacent the upper end of that slot. The numeral 328 denotes a dependent weak spot which is defined by the upper end of the slot 322 and by a triangular notch which extends inwardly from the left-hand edge of the fusible element 320; and the numeral 330 denotes a similar dependent weak spot adjacent the lower end of that slot. The numeral 332 denotes a metal plate which is secured to the front face of the main part of the left-hand electrical conducting path through the fusible element 320; and a similar metal plate, not shown, is secured to the rear face of that main part. The numerals 334 and 336 denote metal plates which are secured to the front and rear faces, respectively, of the main part of the right-hand electrical conducting path through the fusible element 320.

The four metal plates increase the thermal masses of the main parts of the two electrical conducting paths through the fusible element 320; and those increases in thermal mass increase the ability of those main parts to absorb and dissipate the heat which is generated by the controlling weak spots 324 and 326 and by the dependent weak spots 328 and 330. That increased ability to absorb and dissipate heat makes it possible to utilize controlling weak spots of unusually small cross sections; and thereby enables the fusible element 320 to force the rate of rise of the overcurrent to start to diminish at unusually low levels. Further, the increases in thermal mass provided by the four metal plates will reduce the rate at which the arcs, that will form as the controlling weak spots 324 and 326 fuse, can burn through the main parts of the two electrical conducting paths through the fusible element 320; and hence, those main parts have been made much shorter than the main parts 58 and 60 of the two electrical conducting paths of the fusible element 50.

If desired, the metal plates 332, 334, 336 and the counterpart of the metal plate 332, could be eliminated by making the central portion of the fusible element 320 several times wider than shown, and by folding that wider portion in the manner indicated by FIGS. 1 and 2 of H. T. Bussmann U.S. Pat. No. 1,774,252. That folded wire portion would provide an increase in thermal mass which would be generally comparable to the increase in thermal mass provided by those four plates.

The increased thermal mass which is provided for the fusible element 320 by the four metal plates makes it possible for that fusible element to be made from metals and alloys which do not have the high thermal conductivity of silver, silver-copper alloys and copper. Specifically, the fusible element 320 of FIGS. 24 and 25 could be made from zinc, from various copper-nickel alloys, aluminum, brasses, or the like. However, where that fusible element is made from the latter metals and alloys, the slot 322 and the metal plates will preferably be made as long as the slot 56 in the fusible element 50.

Figure 26:
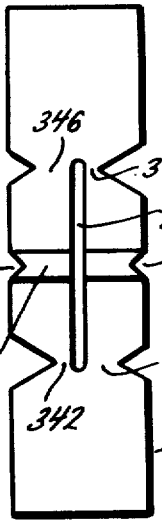
FIG. 26 is a plan view of a preferred embodiment of fusible element which has two masses of alloying material thereon.

Referring particularly to FIG. 26, the numeral 338 generally denotes a fusible element which has an elongated slot 340 therein. The ends of that slot coact with triangular notches which extend inwardly from the opposite edges of the fusible element 338 to define controlling weak spots 342 and 344. The ends of that slot also coact with shallow triangular notches which extend inwardly from the edges of the fusible element 338 to define dependent weak spots 346 and 348. The numeral 350 denotes triangular notches which extend inwardly from the opposite edges of the fusible element 338; and the numeral 352 denotes a layer of alloying material such as tin.

As long as the current flowing through the fusible element 338 is equal to or less than the rated current of that fusible element, the alloying material 352 will not interact with the metal of that fusible element, and all of the weak spots 342, 344, 346, 348 and 350 will remain intact. However, if a potentially-hurtful but relatively-low over-current develops and continues for a predetermined length of time, the alloying material 352 will begin to interact with the metal of the fusible element 338 and to appreciably increase the resistances of the weak spots which are defined by the notches 350 and by the slot 340. If that potentially hurtful but relatively-low overcurrent continues for a long enough time, the alloying material 352 will cause the resistances of the weak spots which are defined by the notches 350 and by the slot 340 to increase to the point where the heat generated by those weak spots will cause those weak spots to fuse. At the relatively low overcurrents at which the alloying material 350 can effect fusing of the weak spots defined by the notches 350 and by the slot 340, the arcing which develops as those weak spots fuse will not be sufficiently severe to cause the main parts of the two electrical conducting paths to burn back to the controlling weak spots 342 and 344 or to the dependent weak spots 346 and 348. Consequently, the fusible element 338 will respond to potentially-hurtful but relatively-low over-currents to form two arcs in parallel; and those arcs will elongate axially of that fusible element to effect prompt opening of the circuit.

In the event a high overcurrent were to develop, the alloying material 352 would not have sufficient time to cause the weak spots that are defined by the notches 350 and by the slot 342 to fuse. Instead, the controlling weak spots 342 and 344 would fuse and would thereby force the rate of rise of the overcurrent to start to diminish. Further, the arcs which would develop as those controlling weak spots fused would start burning away the dependent weak spots 346 and 348. When enough of the dependent weak spots 346 and 348 had burned away to enable those dependent weak spots to fuse, wide series-arranged arcs would develop at the ends of the slot 340. As a result, the fusible element 338 is able to respond to a high overcurrent to promptly cause the rate of rise of the overcurrent to start to diminish, and thereafter is able to provide the desirable arc-interrupting action of a fusible element with series-connected weak spots that fuse simultaneously.

The alloying material 352 can be disposed within transversely-directed identations in the main parts of the two electrical paths of the fusible element 338 or can be mechanically secured to those main parts. If desired, the portions of the main parts of the two electrical paths of the fusible element 338 which are adjacent to that alloying material can be coated with a "solder resist" material before that alloying material is applied to those main parts. In these various ways, that alloying material will be kept from reaching, and adversely affecting, the operation of the controlling weak spots 342 and 344.

Each of the fusible elements shown in FIGS. 1–25 could be used in an electric fuse wherein it would respond to the full range of potentially-hurtful overcurrents from low overcurrents to high overcurrents. However, where those fusible elements are required to respond to potentially-hurtful low overcurrents, the casings in which those fusible elements are mounted should be cooled by moving air or should be made from a ceramic material, just as the casings for other silver and copper fusible elements which must respond to overcurrents should be cooled by moving air or should be made from a ceramic material, because those casings will tend to become quite warm if those fusible elements are operated close to their maximum continuous current-carrying capacities. The fusible element of FIG. 26 can, however, be used in an electric fuse that has a non-ceramic casing, because the alloying material 352 enables that casing to remain relatively cool even when that fusible element must open in response to a potentially-hurtful low overcurrent.

In any event any of the fusible elements of FIGS. 1–25 is used in an electric fuse that is connected in electrical series relation with a protective device which is intended to protect a circuit against potentially-hurtful low overcurrents, those fusible elements can be dimensioned so they will respond only to high overcurrents. Where those fusible elements are so dimensioned, the temperatures of the casings of those electric fuses will remain relatively cool even when the electric circuit experiences long-continued low overcurrents. Examples of protective devices which are intended to protect against potentially-hurtful low overcurrents and which could be connected in electrical series relation with any of the fusible elements of FIGS. 1–25 are other electric fuses, circuit breakers, relays, solder-held connectors, solder-held contacts, and the like.

Figure 27:
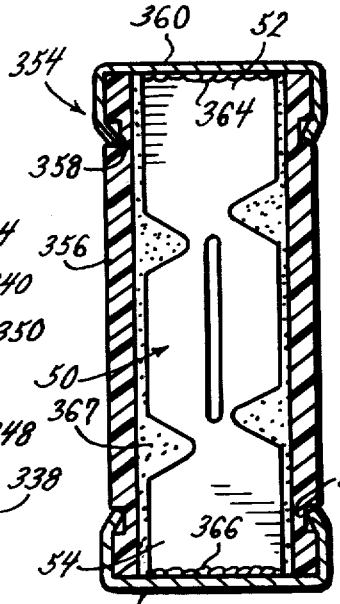
FIG. 27 is a vertical section through an electric fuse which utilizes the fusible element of FIG. 1.

Referring to FIG. 27, the numeral 354 generally denotes an electric fuse in which the fusible element 50 of FIG. 1 is incorporated. That electric fuse has a tubular casing 356 which is made from an inorganic ceramic material such as alumina, porcelain, steatite, or the like. Annular grooves 358 are formed in the outer surface of that tubular casing adjacent the opposite ends of that tubular casing; and cup-shaped end-cap terminals 360 and 362 have the cylindrical portions thereof telescoped over the ends of that tubular casing. Further, the rims of those end-cap terminals are formed into the annular grooves 358 to permanently secure those end-cap terminals to that tubular casing. A mass 364 of solder mechanically connects, and electrically bonds, the terminal 52 of the fusible element 50 to the inner surface of the end-cap terminal 360; and a mass 366 of solder mechanically connects, and electrically bonds, the terminal 54 of that fusible element to the inner surface of the end-cap terminal 362. Arc-extinguishing filler 367 is used to fill the interior of the casing 356 and to immerse the fusible element 50. The electric fuse 354 represents an electric fuse which would have a 250 volt, 35 ampere rating if the fusible element 50 was made of silver and had a thickness of nine ten-thousandths of an inch, and if the filler 367 was quartz sand.

If desired, two or more of the fusible elements 50 could be connected in parallel in the same electric fuse. Where that was done, the tubular casing for that electric fuse could be made with a larger diameter passage therethrough, or the casing for that electric fuse could be made with a plurality of separate passages therethrough — each of which had a transverse dimension large enough to accommodate a fusible element 50. By connecting the desired number of fusible elements 50 in parallel relation within an electric fuse, it is possible to provide almost any desired current rating for an electric fuse.

Where several fusible elements 50 are connected in parallel relation as part of the same electric fuse, each of those fusible elements will operate in the manner described hereinbefore in connection with FIG. 1. Specifically, the controlling weak spots 62 and 64 of each of those fusible elements will respond to a potentially-hurtful over-current which continues for a predetermined length of time to fuse and thereby cause the rate of rise of the over-current to start to diminish. Further, the arcs which form as those controlling weak spots fuse will start to burn into the dependent weak spots 66 and 68; and, when the cross sections of those dependent weak spots have been reduced to the points where those dependent weak spots will fuse, each of the fusible elements will have two wide series-arranged arcs therein. Consequently, where two or more of the fusible elements 50 are incorporated into an electric fuse, the electric fuse will be able to promptly cause the rate of rise of the overcurrent to start to diminish and yet will be able to provide the desirable current-interrupting characteristics of a fusible element which has series-connected weak spots that fuse simultaneously.

Figure 28:
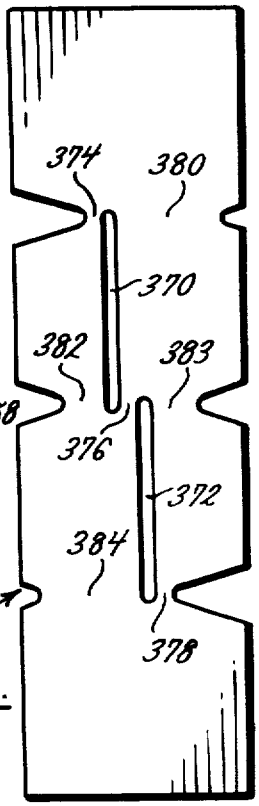
FIG. 28 is a plan view of yet another preferred embodiment of fusible element.

Referring to FIG. 28, the numeral 368 generally denotes a fusible element which has two slots 370 and 372 therein. Those slots extend axially of the fusible element 368; and the slot 370 is disposed at the left-hand side of the axis of that fusible element, while the slot 372 is disposed at the right-hand side of that axis. The numeral 374 denotes a controlling weak spot which is defined by upper end of the slot 370 and by the apex of a generally-triangular notch which extends inwardly from the left-hand edge of the fusible element 368. The numeral 376 denotes a controlling weak spot which is defined by the adjacent ends of the slots 370 and 372; and the numeral 378 denotes a controlling weak spot which is defined by the lower end of the slot 372 and by a generally-triangular notch which extends inwardly from the right-hand edge of the fusible element 368. The numeral 380 denotes a dependent weak spot which is defined by the upper end of the slot 370 and by a shallow generally triangular notch which extends inwardly from the right-hand edge of the fusible element 368; and the numeral 384 denotes a dependent weak spot which is defined by the lower end of the slot 372 and by a shallow generally-triangular notch which extends inwardly from the left-hand edge of that fusible element. The numeral 382 denotes one part of a two-part dependent weak spot; and that part is defined by the lower end of the slot 370 and by an intermediate-depth generally triangular notch which extends inwardly from the left-hand side of the fusible element 368. The numeral 383 denotes the other part of that two-part dependent weak spot; and that other part is defined by the upper end of the slot 372 and by an intermediate-depth generally-triangular notch which extends inwardly from the right-hand edge of the fusible element 368.

The controlling weak spots 374 and 378 have the same widths; but the width of the controlling weak spot 376 could easily be made slightly larger — to compensate for the difference in temperature between that of a weak spot close to the midpoint of a fusible element and that of a weak spot close to the end of that fusible element. The dependent weak spots 380 and 384 have the same widths; but the width of the dependent weak spot which is constituted by the two parts 382 and 383 could easily be made slightly larger — to compensate for the difference in temperature between that of a weak spot close to the midpoint of a fusible element and that of a weak spot close to the end of that fusible element. The parts 382 and 383 have the same widths; and the width of each of those parts is three times the width of the controlling weak spot 374, while the width of each of the dependent weak spots 380 and 384 is six times the width of that controlling weak spot.

The fusible element 368 differs from the fusible element 50 of FIG. 1; but the former fusible element also meets the hereinbefore-specified design criteria. Thus, the value and density of the current flowing through each of the controlling weak spots 374, 376 and 378 will be substantially the same. The value and density of the current flowing through each of the parts of the dependent weak spot 382, 383 will be substantially the same; but the current density in each of those parts will be only one-third of the current density in the controlling weak spot 376. The value and density of the current flowing through each of the dependent weak spots 380 and 384 will be substantially the same, but the current densities in those dependent weak spots will be only one-sixth of the current density in the controlling weak spot 374 or 378. The current density in each end of the fusible element 368 will be less than the current density in any of the weak spots of that fusible element; and hence $$CD_C > CD_D > CD_{FE}$$

Each of the slots 370 and 372 has a width less than one quarter of an inch; and therefore $$W_A \leq \tfrac{1}{4} \text{ of an inch}$$

The value of the current flowing through the dependent weak spot 380 will be twice the value of the current flowing through the controlling weak spot 374; and, similarly, the values of the currents flowing through the dependent weak spots 384 and 382, 383 will be, respectively, twice the values of the currents flowing through the controlling weak spots 378 and 376. As a result, the ratio of $I_D$ to $I_C$ in the fusible element 368 is 2:1; and, consequently, in one size of the fusible element 368, the cross section of each of the dependent weak spots 380, 384 and 382, 383 is, respectively, six times the cross section of any of the controlling weak spots 374, 378 and 376. Accordingly, in the fusible element 368

$$D > C \text{ and}$$

$$D \leq 8\,C\left(\frac{I_D}{I_C}\right)$$

The amount of metal which must burn transversely of the fusible element 368, in response to an arc at the controlling weak spot 374 to enable the dependent weak spot 380 to fuse, is less than one-half of the amount of metal which must burn longitudinally of that fusible element to enable that arc to merge with the arc at the controlling weak spot 376. The amount of metal which must burn transversely of that fusible element in response to an arc at the controlling weak spot 376 to enable the dependent weak spot 382, 383 to fuse, is less than one-half of the amount of metal which must burn longitudinally of that fusible element to enable that arc to merge with the arc at the controlling weak spot 374 or merge with the arc at the controlling weak spot 378; and the amount of metal which must burn transversely of that fusible element in response to an arc at the controlling weak spot 378, to enable the dependent weak spot 384 to fuse, is less than one-half of the amount of metal which must burn longitudinally of that fusible element to enable that arc to merge with the arc at the controlling weak spot 376. As a result, in the fusible element 368, $M_T < (M_L/2)$. Additionally, the fusible element 368 will develop three series-arranged, spaced-apart controlling-dependent arcs as it fuses; and hence $(C,D)_n = n \cdot C$.

The slots 370 and 372 force the current, which flows through the fusible element 368, to flow through three parallel connected electrical conducting paths. The first of those electrical conducting paths includes the weak spots 374, 382 and 384, the second of those electrical conducting paths includes the weak spots 380, 376 and 384, and the third of those electrical conducting paths includes the weak spots 380, 383, and 378. As long as the total current flowing through the fusible element 368 is equal to or less than the rated current of that fusible element, all of the weak spots of that fusible element will remain intact. However, in the event a potentially-hurtful overcurrent develops and continues for a predetermined length of time, all of the controlling weak spots 374, 376 and 378 will fuse. Those controlling weak spots will fuse substantially simultaneously, even though the weak spot 376 may be slightly wider than either of the weak spots 374 and 378; because the portions of the fusible element 368 which are adjacent the weak spot 376 can not absorb and dissipate as much heat as can the portions of that fusible element which are adjacent the weak spots 374 and 378. The fusing of the controlling weak spots 374, 376 and 378 will force the rate of rise of the overcurrent to start to diminish. The arcs which form as those controlling weak spots fuse will begin to burn into the dependent weak spots 380, 384, and 382, 383. Very quickly, the cross sections of those dependent weak spots will be reduced to such extents that those dependent weak spots will fuse; and, thereupon, the fusible element 368 will have three wide series-arranged arcs therein. The first of those wide arcs will be adjacent the upper end of the slot 370, the second of those wide arcs will be adjacent the confronting ends of the slots 370 and 372, and the third of those wide arcs will be adjacent the lower end of the slot 372. All of this means that the fusible element 368 will be able to respond to a potentially-hurtful overcurrent to promptly cause the rate of rise of the overcurrent to start to diminish and also will be able to provide the desirable current-interrupting characteristics of a fusible element which has three series-connected weak spots therein that fuse simultaneously.

Figure 29:
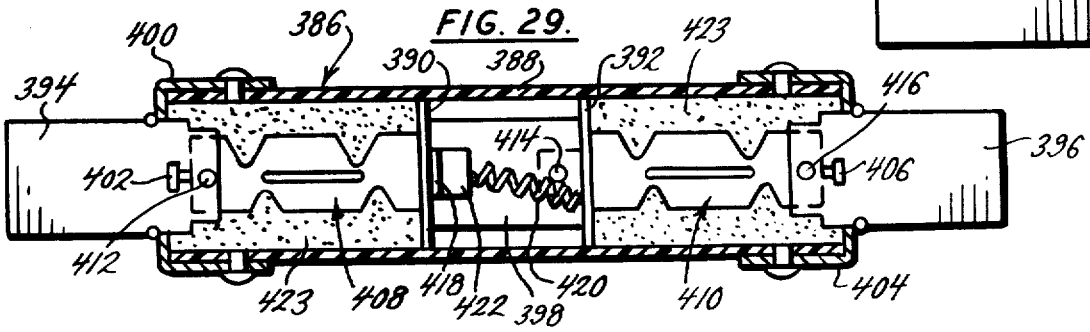
FIG. 29 is a horizontal section through a dual element fuse which includes two fusible elements that are very similar to the fusible element of FIG. 1, FIGS. 30 - 32 are plane views of still further preferred embodiments of fusible elements.

Referring to FIG. 29, the numeral 386 generally denotes a dual element fuse which utilizes two of the fusible elements provided by the present invention. That electric fuse has a tubular casing 388 of insulating material; and circular partitions 390 and 392 of insulating material are disposed within that tubular casing. A knife blade terminal 394 has the inner end thereof extending inwardly through a slot in a cup-like end-cap terminal 400; and that knife blade terminal has two projections which abut the outer end of that slot to limit the extent to which the inner end of that knife blade terminal can be telescoped through that slot. A pin 402 passes through an opening in the inner end of the knife blade terminal 394; and that pin abuts the inner face of the end-cap terminal 400 to limit outward movement of the inner end of that knife blade terminal relative to that end-cap terminal. The numeral 396 denotes a similar knife blade terminal, and the numeral 406 denotes a similar pin. As shown in FIG. 29, the cylindrical portion of the end-cap terminal 400 is telescoped over the left-hand end of the tubular casing 388 and is secured thereto by fasteners; and the cylindrical portion of an end-cap terminal 404 is telescoped over the right-hand end of that tubular casing and is secured thereto by fasteners. A generally-rectangular heat absorber 398 is disposed between the partitions 390 and 392. The numeral 408 denotes a fusible element which is identical to the fusible element 50 of FIG. 1 except for the addition to the right-hand terminal thereof of a tab 418 which extends through a slot in the partition 390. The left-hand end of that fusible element is fixedly secured to the knife blade terminal 394 by a rivet 412. The numeral 410 denotes a fusible element which is identical to the fusible element 50 except for a tab which extends to the left from the left-hand terminal thereof; and that tab is fixedly secured to the heat absorber 398 by a rivet 414. The right-hand terminal of the fusible element 410 is fixedly secured to the knife blade terminal 396 by a rivet 416. A helical extension spring 420 has the right-hand end thereof secured to the partition 392; and it has the left-hand end thereof secured to a connector 422 which is normally held in electrically-conducting relation between the tab 418 and the heat absorber 398 by solder. The fusible elements 408 and 410 are immersed within arc-extinguishing filler 423, such as quartz sand.

The electric fuse 386 is very similar to many cartridge-type, dual element electric fuses which have been marketed by the McGraw-Edison Company, the assignee of this application, in accordance with the teachings of M. F. Duerkob U.S. Pat. No. 2,300,620. The primary difference between the electric fuse 386 and those prior cartridge-type, dual element electric fuses resides in the use of the fusible elements 408 and 410 instead of fusible elements which have a number of series-arranged weak spots therein.

Current normally flows from the knife blade terminal 394 via fusible element 408, tab 418 of that fusible element, connector 422, heat absorber 398, the tab of fusible element 410, and the rest of that fusible element to the knife blade terminal 396. In the event a low but potentially-hurtful overcurrent develops and continues for a predetermined length of time, the heat which is generated by the fusible elements 408 and 410 will cause the temperature of the heat absorber 398 to rise to the softening temperature of the solder which normally holds the connector 422 against movement. As that solder softens, the spring 420 will pull that connector away from the tab 418 of the fusible element 408, and will thereby open the circuit.

In the event a high overcurrent develops, the controlling weak spots of both of the fusible elements 408 and 410 will open, and will thereby force the rate of rise of the overcurrent to start to diminish. The arcs, which develop as those controlling weak spots fuse, will start burning into the dependent weak spots of those fusible elements; and, as soon as the cross sections of those dependent weak spots have been sufficiently reduced by that burning, those dependent weak spots also will fuse. At such time, there will be four wide series-arranged arcs within the electric fuse 386 — two wide series-arranged arcs in the fusible element 408 and two wide series-arranged arcs in the fusible element 410. By utilizing the fusible elements 408 and 410 instead of fusible elements which have a number of series-arranged weak spots, the present invention makes it possible for the electric fuse 386 to provide even more prompt diminishing of the rate of rise of the overcurrent, and to be even more sturdy and rugged.

Figures 30, 31, 32, 33, 34, 35, 36, 37, 38, 39:
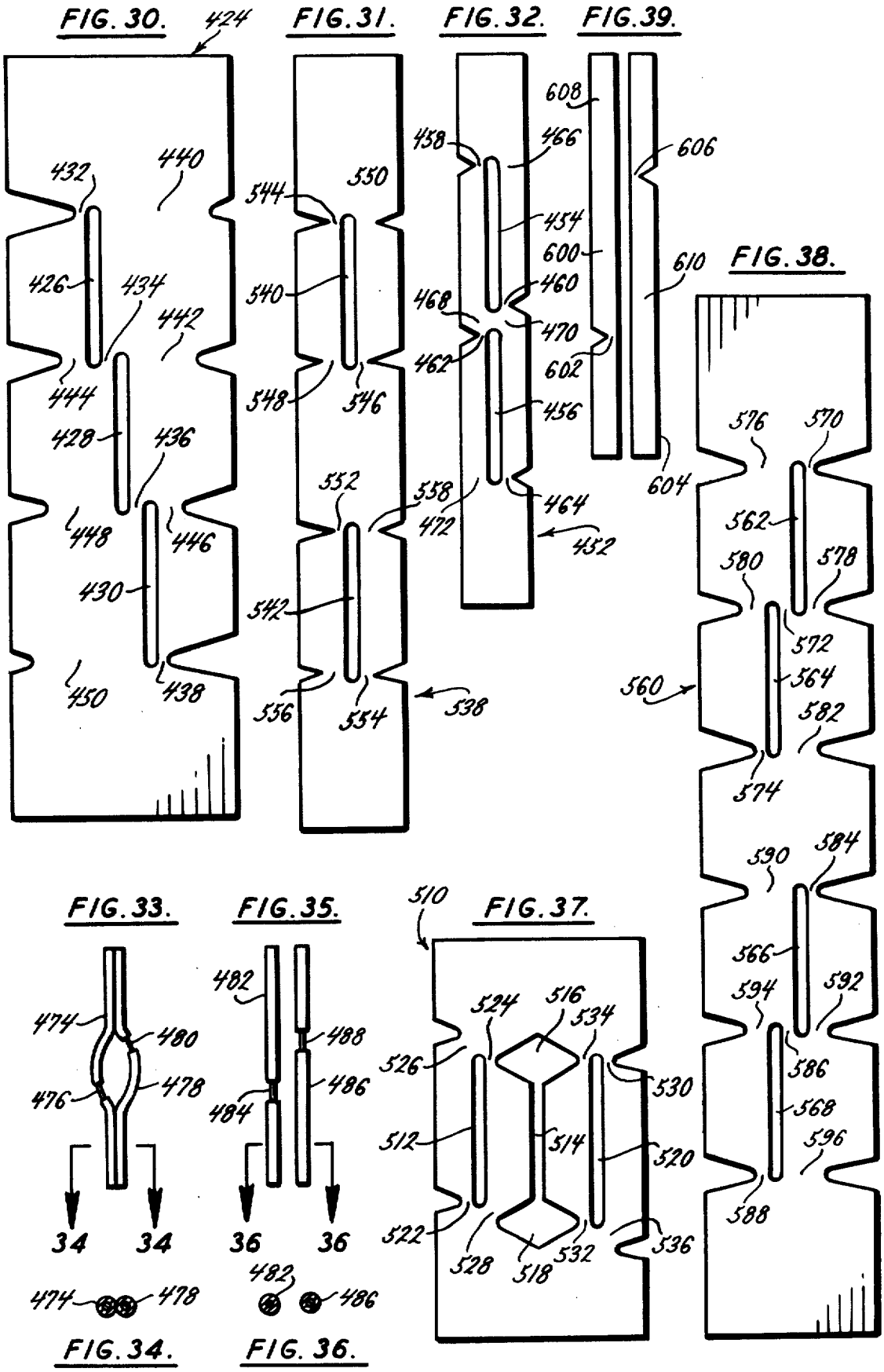
FIG. 33 is a plan view of two wires which coact to constitute a preferred embodiment of fusible element.
FIG. 34 is a sectional view, on a larger scale, through the wires of FIG. 33, and it is taken along the plane indicated by the line 34—34 in FIG. 33.
FIG. 35 is a plan view of two further wires which coact to constitute a preferred embodiment of fusible element.
FIG. 36 is a sectional view, on a larger scale, through the wires of FIG. 35, and it is taken along the plane indicated by the line 36—36 in FIG. 35, FIGS. 37 – 39 are plan views of three additional preferred embodiments of fusible elements.

Referring to FIG. 30, the numeral 424 generally denotes a fusible element which has three slots 426, 428 and 430. The geometric center of the slot 428 is coincident with the geometric center of that fusible element, the slot 426 is disposed to the left of the axis of that fusible element, and the slot 430 is disposed to the right of that axis. The numerals 432, 434, 436 and 438 denote controlling weak spots. The controlling weak spot 432 is defined by the upper end of the slot 426 and by a deep generally triangular notch which extends inwardly from the left-hand edge of the fusible element 424; and the controlling weak spot 438 is defined by the lower end of the slot 430 and by a deep generally-triangular notch which extends inwardly from the right-hand edge of that fusible element. The controlling weak spot 434 is defined by the adjacent ends of the slots 426 and 428, and the controlling weak spot 436 is defined by the adjacent ends of the slots 428 and 430. The numeral 440 denotes a dependent weak spot which is defined by the upper end of the slot 426 and by a shallow generally-triangular notch which extends inwardly from the right-hand edge of the fusible element 424; and the numeral 450 denotes a dependent weak spot which is defined by the lower end of the slot 430 and by a shallow generally-triangular notch which extends inwardly from the left-hand edge of that fusible element. The numeral 442 denotes one part of a further dependent weak spot; and that part is defined by the upper end of the slot 428 and by an intermediate-depth, generally-triangular notch which extends inwardly from the right-hand edge of the fusible element 424. The numeral 444 denotes the other part of that further dependent weak spot; and that other part is narrower than the part 442, and it is defined by the lower end of the slot 426 and by a slightly-deeper, generally triangular notch which extends inwardly from the left-hand edge of that fusible element. The numeral 446 denotes one part of a still further dependent weak spot; and that part has the same width as the part 444, but it is defined by the upper end of the slot 430 and by a generally triangular notch which extends inwardly from the right-hand edge of the fusible element 424. The numeral 448 denotes the other part of that still further dependent weak spot, and that other part has the same width as the part 442, but it is defined by the lower end of the slot 428 and by an intermediate-depth, generally-triangular notch which extends inwardly from the left-hand edge of the fusible element 424.

The controlling weak spots 432 and 438 have the same widths, but the width of each of the controlling weak spots 434 and 436 could easily be made slightly larger — to compensate for the difference in temperature between that of a weak spot close to the midpoint of a fusible element and that of a weak spot close to the end of that fusible element. The dependent weak spots 440 and 450 have the same widths; but the width of each of the dependent weak spots 442, 444 and 446, 448 could easily be made slightly larger — to compensate for the difference in temperature between that of a weak spot close to the midpoint of a fusible element and that of a weak spot close to the end of that fusible element. Further, the parts 444 and 446 have the same widths but the width of each of the parts 442 and 448 is substantially twice that of either of the parts 444 and 446, and the width of each of the dependent weak spots 440 and 450 is substantially three times that of either of the parts 444 and 446. In one size of the fusible element 424, the width of each part 444 and 446 was three times the width of the controlling weak spot 432, the width of each part 442 and 448 was six times the width of that controlling weak spot, and the width of each dependent weak spot 440 and 450 was nine times the width of that controlling weak spot. The values and densities of the currents flowing through the controlling weak spots 432, 434, 436 and 438 will be substantially the same; and the values and densities of the currents flowing through the parts 444 and 446 will be substantially the same, but the current density in each of those parts will be only one-third of the current density in the controlling weak spot 432. The values and densities of the currents flowing through the parts 442 and 448 will be substantially the same, but the current density in each of those parts will be only one-sixth of the current density in the controlling weak spot 432. The values and densities of the currents flowing through the dependent weak spots 440 and 450 will be substantially the same, but the current densities in those dependent weak spots will be only one-ninth of the current density in the controlling weak spot 432.

The slots 426, 428 and 430 force the current, which flows through the fusible element 424, to pass through four electrical conducting paths which are in electrical parallel relation. One of those electrical conducting paths includes the weak spots 432, 444, 448 and 450, the second of those electrical conducting paths includes the weaks spots 440, 434, 448 and 450, the third of those electrical conducting paths includes the weak spots 440, 442, 436 and 450, and the fourth of those electrical conducting paths includes the weak spots 440, 442, 446 and 438.

As long as the current flowing through the fusible element 424 is equal to or less than the rated current of that fusible element, all of the weak spots of that fusible element will remain intact. In the event a potentially-hurtful overcurrent develops and continues for a predetermined length of time, all of the controlling weak spots 432, 434, 436 and 438 will fuse. Those controlling weak spots will fuse substantially simultaneously, even though the weak spots 434 and 436 may be slightly wider than either of the weak spots 432 and 438; because the portions of the fusible element 424 which are adjacent the weak spots 434 and 436 can not absorb and dissipate as much heat as can the portions of that fusible element which are adjacent the weak spots 432 and 438. The fusing of the controlling weak spots 432, 438, 434 and 436 will force the rate of rise of the overcurrent to start to diminish. The arcs which develop as those controlling weak spots fuse will begin to burn into the dependent weak spots 440 and 450 and into the dependent weak spots 442, 444 and 446, 448. Very quickly, the cross sections of those dependent weak spots will be reduced to such extents that those dependent weak spots will fuse; and, thereupon, the fusible element 424 will have four series-arranged arcs therein; and hence that fusible element will provide the current-interrupting action of a fusible element which has four series-arranged weak spots that fuse simultaneously.

Referring particularly to FIG. 31, the numeral 538 denotes a fusible element which has two elongated slots 540 and 542 therein. Those slots are coaxial with the axis of that fusible element; and they are spaced apart a distance which is approximately equal to the length of either of those slots. The numerals 544 and 546 denote controlling weak spots that are defined, respectively, by the upper and lower ends of the slot 540 and by triangular notches which extend inwardly from the opposite edges of the fusible element 538. The numerals 548 and 550 denote dependent weak spots which are defined, respectively, by the lower and upper ends of the slot 540 and by triangular notches which extend inwardly from the opposite edges of the fusible element 538. The numerals 552 and 554 denote controlling weak spots which are defined, respectively, by the upper and lower ends of the slot 542 and by triangular notches which extend inwardly from the opposite edges of the fusible element 538. The numerals 556 and 558 denote dependent weak spots which are defined, respectively, by the lower and upper ends of the slot 542 and by triangular notches which extend inwardly from the opposite edges of the fusible element 538. The weak spots 544 and 554 have the same widths, and the weak spots 546 and 552 may be slightly wider; because the portions of the fusible element 538 which are adjacent the weak spots 546 and 552 are unable to absorb and dissipate as much heat as are the portions of that fusible element adjacent the weak spots 544 and 554. Similarly, the weak spots 548 and 558 may be slightly wider than the weak spots 550 and 556, because the portions of the fusible element 538 which are adjacent the weak spots 548 and 558 are not able to absorb and dissipate heat as rapidly as are the portions of that fusible element which are adjacent the weak spots 550 and 556.

The fusible element 538 is comparable to two fusible elements 50 of FIG. 1 which are arranged in end-to-end relation but which are made from the same piece of metal. Specifically, the slot 540, the controlling weak spots 544 and 546, and the dependent weak spots 548 and 550 are comparable to the slot 56, the controlling weak spots 62 and 64, and the dependent weak spots 66 and 68 of a first fusible element 50; and the slot 542, the controlling weak spots 552 and 554, and the dependent weak spots 556 and 558 of the fusible element 538 are comparable to the slot 56, the controlling weak spots 62 and 64, and the dependent weak spots 66 and 68 of a second fusible element 50.

As long as the current flowing through the fusible element 538 is equal to or less than the rated current of that fusible element, all of the weak spots of that fusible element will remain intact. In the event a potentially hurtful overcurrent develops and continues for a predetermined length of time, all of the controlling weak spots 544, 546, 552 and 554 will fuse. Those controlling weak spots will fuse substantially simultaneously, even though the weak spots 546 and 552 may be slightly wider than either of the weak spots 544 and 554; because the portions of the fusible element 538 which are adjacent the former weak spots can not absorb and dissipate as much heat as can the portions of that fusible element which are adjacent the latter weak spots. The fusing of the controlling weak spots 544, 546, 552 and 554 will force the rate of rise of the overcurrent to start to diminish. The arcs which develop as those controlling weak spots fuse will begin to burn into the dependent weak spots 550, 548, 558 and 556. Very quickly the cross sections of those dependent weak spots will be reduced to such extents that those dependent weak spots will fuse; and, thereupon, the fusible element 538 will have four series-arranged arcs therein; and hence that fusible element will provide the arc-interrupting action of a fusible element which has four series-arranged weak spots that fuse simultaneously.

The fusible element 424 of FIG. 30 and the fusible element 538 of FIG. 31 have similarities and dissimilarities. Specifically, each of those fusible elements has four controlling weak spots and has four dependent weak spots, will form four wide series-arranged arcs as it fuses, and will meet the hereinbefore-specified design criteria. However, each of the dependent weak spots 548, 550, 556 and 558 of the fusible element 538 is a single-part weak spot, and the value of the current flowing through each of those weak spots will be the same; whereas each of the dependent weak spots 442, 444 and 446, 448 is a two-part weak spot, and the value of the current flowing through each of the parts 442 and 448 is twice the value of the current flowing through either of the parts 444 and 446 and the value of the current flowing through each of the weak spots 440 and 450 is three times the value of the current flowing through either of the parts 444 and 446. Further, all of the controlling weak spots of the fusible element 424 are in parallel, and hence the effective resistance of those controlling weak spots is only one-quarter of the resistance of any one of those controlling weak spots; whereas the controlling weak spots of the fusible element 538 are arranged in series-parallel relation, and hence the effective resistance of those controlling weak spots is equal to the resistance of one of those controlling weak spots. Also, the fusible element 424 is wider, slightly shorter, sturdier, and contains more metal than a fusible element 538 of equal thickness. Where width limitations permit, and where the cost of the extra metal is not a bar, the fusible element 424 will usually be used instead of the fusible element 538.

Referring particularly to FIG. 32, the numeral 452 generally denotes a fusible element which has two elongated slots 454 and 456 therein; and those slots are coaxial with that fusible element. The numerals 458 and 460 denote controlling weak spots which are defined, respectively, by the upper and lower ends of the slot 454 and by triangular notches which extend inwardly from the opposite edges of the fusible element 452. The numerals 462 and 464 denote further controlling weak spots which are defined, respectively, by the upper and lower ends of the slot 456 and by triangular notches which extend inwardly from the opposite edges of the fusible element 452. The numeral 466 denotes a dependent weak spot which is defined by the upper end of the slot 454 and by the right-hand edge of the fusible element 452; and the numeral 472 denotes a dependent weak spot which is defined by the lower end of the slot 456 and by the left-hand side of that fusible element. The numeral 468 denotes a dependent weak spot which is defined by the lower end of the slot 454 and by the triangular notch which helps define the controlling weak spot 462. The numeral 470 denotes a dependent weak spot which is defined by the upper end of the slot 456 and by the triangular notch which helps define the controlling weak spot 460. The width of each of the controlling weak spots 460 and 462 may be slightly greater than the width of either of the controlling weak spots 458 and 464; because the portions of the fusible element 452 which are adjacent the former weak spots can not absorb and dissipate heat as rapidly as can the portions of that fusible element which are adjacent the latter weak spots.

As long as the current flowing through the fusible element 452 is equal to or less than rated current of that fusible element, all of the weak spots of that fusible element will remain intact. In the event a potentially-hurtful overcurrent develops and continues for a predetermined length of time, all of the controlling weak spots 458, 460, 462 and 464 will fuse and thereby force the rate of rise of that overcurrent to start to diminish. The arcs which form as those controlling weak spots fuse will start burning into the dependent weak spots 466, 468, 470 and 472; and, when that burning sufficiently reduces the cross sections of those dependent weak spots, those dependent weak spots also will fuse. At such time, the arcs at the weak spots 458 and 466 will merge to constitute one wide arc, the arcs at the weak spots 460, 462, 468 and 470 will merge to constitute a second wide arc, and the arcs at the weak spots 464 and 472 will merge to constitute a third wide arc. Those three wide arcs will be in series relation; and hence the fusible element 452 will not only provide prompt diminishing of the rate of rise of the overcurrent but also will provide the current-interrupting effect provided by a fusible element that has three series-arranged weak spots which fuse simultaneously.

The fusible element 452 of FIG. 32 differs from the fusible element 538 of FIG. 31 in that the slots 454 and 456 of the former fusible element are so close to each other that the controlling-dependent arc at the weak spots 460 and 468 merge into the controlling-dependent arc at the weak spots 462 and 470, whereas the slots 540 and 542 of the latter fusible element are spaced apart far enough to keep the controlling-dependent arc at the weak spots 546 and 548 from merging with the controlling-dependent arc at the weak spots 552 and 558. As a result, the fusible element 452 will be able to form only three series-arranged arcs when it fuses, whereas the fusible element 538 will form four series-arranged arcs when it fuses.

Where space limitations permit, and where the circuit voltage is in the neighborhood of six hundred volts, it will usually be desirable to use the fusible element 538 of FIG. 31 rather than the fusible element 452 of FIG. 32. However, where space limitations do not permit the use of the fusible element 538 but do permit the use of the fusible element 452, and where the circuit voltage is between two hundred and fifty volts, and six hundred volts, it will usually be desirable to use the fusible element 452 of FIG. 32 rather than the fusible element of FIG. 1; because the former fusible element will provide three series-arranged arcs when it fuses, whereas the latter fusible element will provide just two series-arranged arcs when it fuses.

Referring particularly to FIGS. 33 and 34, the numeral 474 denotes a wire which has a weak spot 476; and the numeral 478 denotes a wire which has a weak spot 480. Those wires constitute a fusible element which is made in accordance with the principles and teachings of the present invention. The weak spots 476 and 480 can be formed in various ways; but they are conveniently formed by covering short portions of the wires 474 and 478 and then electroplating the remaining portions of those wires. The ends of the wire 474 define an axis, but the central portion of that wire has been bowed to the left from that axis. The ends of the wire 478 define a second axis, but the central portion of that wire has been bowed to the right of that second axis. The ends of the wires 474 and 478 abut each other, and they will be mechanically secured and electrically bonded to the end cap terminals of a cartridge-type electric fuse; and the central portions of those wires will define an ovate space.

The weak spot 476 is adjacent the point where the wires 474 and 478 diverge to form the lower portion of the ovate space; and the weak spot 480 is close to the point where those wires diverge to define the upper portion of that ovate space. The weak spot 476 is displaced from the nearest portion of the wire 478 by a distance which is less than one-quarter of an inch; and similarly, the weak spot 480 is displaced from the nearest portion of the wire 474 by a distance which is less than one-quarter of an inch. The casing of the cartridge-type electric fuse in which the wires 474 and 478 are incorporated can be filled with arc-extinguishing filler or air.

As long as the current flowing through the fusible element 474, 478 is equal to or less than the rated current of that fusible element, the weak spots 476 and 480 will remain intact. In the event a potentially-hurtful over-current develops and continues for a predetermined length of time, both of the weak spots 476 and 480 will fuse and force the rate of rise of that overcurrent to start to diminish. The arc which develops as the weak spot 476 fuses will cause the adjacent portions of the wire 474 to burn and also will cause the adjacent portion of the wire 478 to start to burn; and, similarly, the arc which forms as the weak spot 480 fuses will cause the adjacent portions of the wire 478 to start to burn and also will cause the adjacent portion of the wire 474 to start to burn. As soon as the burning of the portion of the wire 474 which is adjacent the weak spot 480 sufficiently reduces the cross-section of that portion, that portion will fuse; and, similarly, as soon as the burning of the portion of the wire 478 which is adjacent the weak spot 476 sufficiently reduces the cross section of that portion, that portion will fuse. Thereupon, each of the electrical conducting paths will have two series-arranged arcs therein; and hence the cartridge-type electric fuse which incorporates the fusible element 474, 478 therein will have the current-interrupting characteristics of a fusible element that has two series-arranged weak spots which fuse simultaneously.

Referring particularly to FIGS. 35 and 36, the numeral 482 denotes a wire which has a weak spot 484; and the numeral 486 denotes a wire which has a weak spot 488. The wires 482 and 486 of FIGS. 35 and 36 constitute a fusible element which is made in accordance with the principles and teachings of the present invention. The wires 482 and 486 differ from the wires 474 and 478 of FIGS. 33 and 34 in that the former wires are straight throughout the lengths thereof and have the ends thereof laterally spaced apart. The distance between the weak spot 484 and the adjacent portion of the wire 486 preferably is about one thirty-second of an inch but should not exceed three thirty-seconds of an inch; and, similarly, the distance between the weak spot 488 and the adjacent portion of the wire 482 preferably is about one thirty-second of an inch but should not exceed three thirty-seconds of an inch.

The current-carrying and current-interrupting action of the wires 482 and 486 of FIGS. 35 and 36 will be very similiar to the current-carrying and current-interrupting characteristics of the wires 474 and 478 of FIGS. 33 and 34. The primary advantage of the wires 474 and 478 over the wires 482 and 486 is the progressive increase in lateral spacing between the arcs which develop in the wires 474 and 478.

Referring to FIG. 37, the numeral 510 generally denotes a fusible element which has elongated slots 512, 514 and 520. The slot 514 is coaxial with the axis of the fusible element 510; and the slot 512 is located at one side of that axis, while the slot 520 is located at the opposite side of that axis. A diamond-shaped enlargement 516 is provided at the top of the slot 514, and a similar enlargement 518 is provided at the bottom of that slot. The numeral 522 denotes a controlling weak spot which is defined by the lower end of the slot 512 and by a generally triangular notch which extends inwardly from the left-hand edge of the fusible element 510; and the numeral 524 denotes a controlling weak spot of the same size which is defined by the upper end of that slot and by the enlargement 516. The numeral 526 denotes a dependent weak spot which is defined by the upper end of the slot 512 and by a generally triangular notch which extends inwardly from the left-hand edge of the fusible element 510; and the numeral 528 denotes a dependent weak spot of the same width which is defined by the lower end of that slot and by the enlargement 518. The numeral 530 denotes a controlling weak spot which is defined by the upper end of the slot 520 and by a generally-triangular notch which extends inwardly from the right-hand edge of the fusible element 510; and the numeral 532 denotes a controlling weak spot of the same width which is defined by the lower end of that slot and by the enlargement 518. The numeral 534 denotes a dependent weak spot which is defined by the upper end of the slot 520 and by the enlargement 516; and the numeral 536 denotes a dependent weak spot of the same width which is defined by the lower end of that slot and by a generally-triangular notch which extends inwardly from the right-hand edge of the fusible element 510.

The fusible element 510 is comparable to two fusible elements 50 of FIG. 1 which are arranged in side-by-side relation but which are made from the same piece of metal. Specifically, the slot 512, the controlling weak spots 522 and 524, and the dependent weak spots 526 and 528 of the fusible element 510 are comparable to the slot 56, the controlling weak spots 62 and 64, and the dependent weak spots 66 and 68 of a first fusible element 50; and the slot 520, the controlling weak spots 530 and 532, and the dependent weak spots 536 and 534 of the fusible element 510 are comparable to the slot 56, the controlling weak spots 62 and 64, and the dependent weak spots 66 and 68 of a second fusible element 50. The fusible element 510 is stiffer and more rugged than is the fusible element 50, and it also is stiffer and more rugged than two parallel-connected fusible elements 50. As a result, in electric fuses which could accommodate the greater width of the fusible element 510, and where the greater stiffness and ruggedness of that fusible element would be helpful, that fusible element could be used instead of two fusible elements 50 that were arranged in parallel relation.

As long as the current flowing through the fusible element 510 is equal to or less than the rated current of that fusible element, all of the weak spots of that fusible element will remain intact. While all of those fusible element are intact, the current which flows through that fusible element will flow through four electrical conducting paths that are in parallel relation. One of those electrical conducting paths includes the weak spots 526 and 522, the second of those electrical conducting paths includes the weak spots 524 and 528, the third of those electrical conducting paths includes the weak spots 534 and 532, and the fourth of those electrical conducting paths includes the weak spots 530 and 536. The total resistance of the fusible element 510 will be substantially equal to one-fourth of the resistance of any one of the weak spots 522, 524, 532 and 530.

If a potentially-hurtful overcurrent develops and continues for a predetermined length of time, the controlling weak spots 522, 524, 530 and 532 will fuse almost simultaneously and will force the rate of rise of the overcurrent to start to diminish. The arcs which develop as those controlling weak spots fuse will begin to burn into the dependent weak spots 526, 528, 534 and 536; and, when the cross sections of those dependent weak spots are sufficiently reduced by that burning, those dependent weak spots will fuse. Thereupon, the arcs at the weak spots 526 and 524 will merge into one wide arc, the arcs at the weak sport 522 and 528 will merge into a second wide arc which is in series relation with the first wide arc, the arcs at the weak spots 534 and 530 will merge into a third wide arc which is in parallel relation with the first wide arc, and the arcs at the weak spots 532 and 536 will merge into a fourth wide arc which is in series relation with the third wide arc. Consequently, the fusible element 510 can provide the current-carrying characteristics of two fusible elements that are connected in electric parallel relation, while also providing the current-interrupting characteristics of a fusible element that has two series-arranged weak spots that fuse simultaneously.

Referring to FIG. 38, the numeral 560 generally denotes a fusible element which has slots 562, 564, 566 and 568 therein. The slots 564 and 568 are disposed at the left-hand side of the axis of that fusible element, while the slots 562 and 566 are disposed at the righe-hand side of that axis. The numeral 570 denotes a controlling weak spot which is defined by the upper end of the slot 562 and by a generally triangular notch which extends inwardly from the right-hand edge of the fusible element 560. The numeral 572 denotes a controlling weak spot which is defined by the adjacent ends of the slots 562 and 564; and the numeral 574 denotes a controlling weak spot which is defined by the lower end of the slot 564 and by a generally-triangular notch which extends inwardly from the left-hand edge of the fusible element 560. The numeral 576 denotes a dependent weak spot which is defined by the upper end of the slot 562 and by a generally-triangular notch which extends inwardly from the left-hand edge of the fusible element 560; and the numeral 582 denotes a dependent weak spot which is defined by the lower end of the slot 564 and by a generally-triangular notch which extends inwardly from the right-hand edge of that fusible element. The numerals 578 and 580 denote parts of a two-part dependent weak spot which is defined by the lower end of the slot 562 and by the upper end of the slot 564 and by generally-triangular notches which extend inwardly from the opposite edges of the fusible element 560.

The numeral 584 denotes a controlling weak spot which is defined by the upper end of the slot 566 and by a generally-triangular notch which extends inwardly from the right-hand edge of the fusible element 560. The numeral 586 denotes a controlling weak spot which is defined by the adjacent ends of the slots 566 and 568; and the numeral 588 denotes a controlling weak spot which is defined by the lower end of the slot 568 and by a generally-triangular notch which extends inwardly from the left-hand edge of the fusible element 560. The numeral 590 denotes a dependent weak spot which is defined by the upper end of the slot 566 and by a generally-triangular notch which extends inwardly from the left-hand edge of the fusible element 560; and the numeral 596 denotes a dependent weak spot which is defined by the lower end of the slot 568 and by a generally-triangular notch which extends inwardly from the right-hand edge of that fusible element. The numerals 592 and 594 denote parts of a two-part weak spot which is defined by the lower end of the slot 566 and by the upper end of the slot 568 and by generally-triangular notches which extend inwardly from the opposite edges of the fusible element 560.

The fusible element 560 is comparable to two fusible elements 368 of FIG. 28 that are arranged in end-to-end relation but which are made from the same piece of metal. Specifically, the slots 562 and 564, the controlling weak spots 570, 572 and 574, and the dependent weak spots 576, 582 and 580, 578 of the fusible element 560 are comparable to the slots 370 and 372, the controlling weak spots 374, 376 and 378, and the dependent weak spots 380, 384 and 382, 383 of a first fusible element 368 of FIG. 28; and the slots 566 and 568, the controlling weak spots 584, 586 and 588, and the dependent weak spots 590, 596 and 592, 594 are comparable to the slots 370 and 372, the controlling weak spots 374, 376 and 378, and the dependent weak spots 380, 384 and 382, 383 of a second fusible element 368. The fusible element 560 will have about twice the electrical resistance of the fusible element 368 of FIG. 28, but it will provide twice the number of series-arranged arcs as it fuses. As a result, the fusible element 560 can be used in electric fuses which must withstand higher voltages than the electric circuits in which the fusible element 368 will be used.

Referring to FIG. 39, the numeral 600 denotes a metal strip which has a weak spot 602 therein; and that weak spot is defined by the right-hand edge of that metal strip and by a triangular notch which extends inwardly from the left-hand edge of that fusible element. The numeral 604 denotes a metal strip which is identical to the metal strip 600 but which is turned end-for-end relative to that metal strip. The numeral 606 denotes a weak spot in the metal strip 604; and that weak spot is defined by the left-hand edge of that metal strip and by a triangular notch which extends inwardly from the right-hand edge of that metal strip. The uninterrupted edges of the metal strips 600 and 604 confront each other but are spaced apart a short distance. Preferably that distance is about one thirty-second of an inch, but it should not exceed three thirty-seconds of an inch. The portion of the metal strip 600 which is in register with the weak spot 606 of the metal strip 604 is denoted by the numeral 608, and it will act as a dependent weak spot. Similarly, the portion of the metal strip 604 which is in register with the weak spot 602 of the fusible element 600 is denoted by the numeral 610, and it will act as a dependent weak spot. The metal strips 600 and 604 will have the ends thereof mechanically secured and electrically bonded to the end terminals of an electric fuse; and those metal strips will coact to constitute a fusible element that is made in accordance with the principles and teachings of the present invention.

The current flowing through that cartridge-type electric fuse will divide evenly between the metal strips 600 and 604. As long as the value of that current is equal to or less than the rated current of that electric fuse, the controlling weak spots 602 and 606 will remain intact, and hence the dependent weak spots 608 and 610 also will remain intact. In the event a potentially-hurtful overcurrent develops and continues for a predetermined length of time, both of the controlling weak spots 602 and 606 will fuse and will force the rate of rise of that overcurrent to start to diminish. The arc which develops as the weak spot 602 fuses will cause the adjacent portions of the metal strip 600 to start to burn, and also will cause the portion 610 of the metal strip 604 to start to burn; and, similarly, the arc which forms as the weak spot 606 fuses will casue the adjacent portions of the metal strip 604 to start to burn, and also will cause the portion 608 of the metal strip 600 to start to burn. As soon as the burning of the dependent weak spots 608 and 610 sufficiently reduces the cross sections of those dependent weak spots, those dependent weak spots will fuse. Thereupon, each of the metal strips 600 and 604 will have two series-arranged arcs therein; and hence the cartridge-type electric fuse which has those metal strips incorporated therein will have the current-interrupting characteristics of a fusible element that has two series-arranged weak spots which fuse simultaneously.

The metal strips 600 and 604 will not have the strength and ruggedness possessed by each of the various fusible elements of the present invention that are one-piece fusible elements with slots or slits therein; because the dependent weak spot 608 will not be able to provide any stiffening or reinforcing effect for the metal strip 604; and, similarly, the dependent weak spot 610 will not be able to provide any stiffening or reinforcing effect for the metal strip 600. Furthermore, it is not as easy to maintain a desired spacing between the confronting edges of the metal strips 600 and 604 as it is to maintain a desired spacing between the confronting edges of the main parts of parallel-arranged electrical paths that are defined by an elongated slot in a single piece of metal. Consequently, in most instances, it will be preferable to use a fusible element which is made from a single piece of metal rather than a fusible element which is made from a pair of metal strips.

Figure 40:
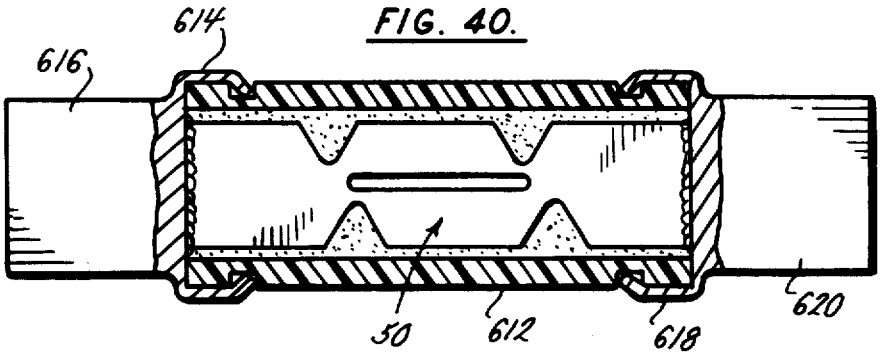
FIG. 40 is a vertical section through an electric fuse which utilizes the fusible element of FIG. 1.

Referring to FIG. 40, the numeral 612 denotes the casing of an electric fuse which is similar to the electric fuse of FIG. 27. However, the end-cap terminals 614 and 618 of the electric fuse of FIG. 40 have kinfe blades 616 and 620 thereon. That electric fuse has a fusible element 50 therein; and that fusible element will differ primarily from the identically-numbered fusible element in FIG. 27 by being thicker. Where the fusible element of FIG. 40 has a thickness of five thousandths of an inch, the rating of the the electric fuse in which it is incorporated will be one hundred amperes.

Figure 41:
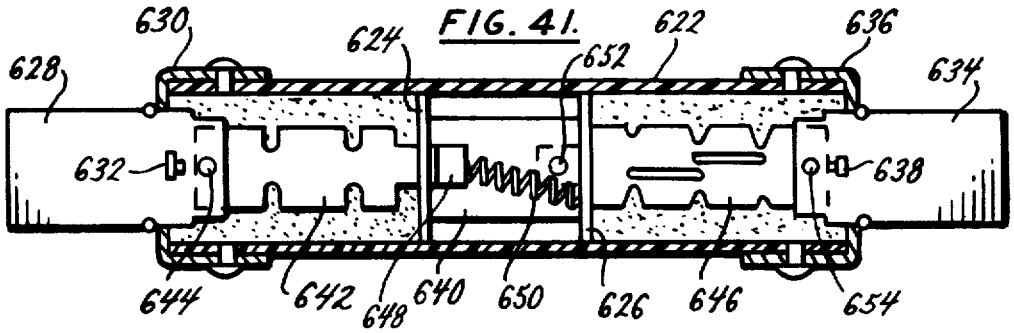
FIG. 41 is a horizontal section through a dual element fuse which includes a fusible element that is very similar to the fusible element of FIG. 28.

Referring to FIG. 41, the numeral 622 denotes the casing of a dual element electric fuse which resembles the type of electric fuse shown in A. J. Fister U.S. Pat. No. 3,122,619. That casing is made of insulating material; and circular partitions 624 and 626 of insulating material are disposed within the casing. A knife blade terminal 628 has the inner end thereof extending inwardly through a slot in a cup-like end-cap terminal 630; and that knife blade terminal has two projections which abut the outer end of that slot to limit the extent of which the inner end of that knife blade terminal can be telescoped through that slot. A pin 632 is disposed within an opening in the inner end of the knife blade terminal 628; and that pin abuts the inner face of the end-cap terminal 630 to limit outward movement of the inner end of that knife blade terminal relative to that end-cap terminal. The numeral 634 denotes a similar knife blade terminal, the numeral 636 denotes a similar end-cap terminal, and the numeral 638 denotes a similar pin. As shown by FIG. 41, the cylindrical portion of the end-cap terminal 630 is telescoped over the left-hand end of the tubular casing 622 and is secured thereto by fasteners; and the cylindrical portion of the end-cap terminal 636 is telescoped over the right-hand end of that tubular casing and is secured thereto by fasteners. A generally-rectangular heat absorber 640 is disposed between the partitions 624 and 626. The numeral 624 denotes a conductor which is made so it will generate appreciable amounts of heat whenever currents greater than the rated current of the dual element fuse pass through it; and that conductor can be identical to the corresponding conductor in the said Fister patent. A rivet 644 fixedly secures the left-hand end of the conductor 642 to the knife blade terminal 628. The numeral 646 denotes a fusible element which can be identical to the fusible element 368 in FIG. 28 except for the provision of tabs which facilitate the securing of that fusible element to the heat absorber 640 and to the knife blade terminal 634. A rivet 652 secures the tab at the left-hand end of the fusible element 646 to the heat absorber 640; and a rivet 654 secures the tab at the right-hand end of that fusible element to the knife blade terminal 634. The numeral 648 denotes a connector which normally is held in electrical conducting relation with the right-hand end of the conductor 642 and the left-hand end of the heat absorber 640 by solder; and the numeral 650 denotes a helical extension spring which biases that connector for movement to the right.

The dual element fuse of FIG. 41 differs from the dual element fuse of the said Fister patent in replacing the short-circuiting chamber of the latter dual element fuse with the fusible element 646. The dual element fuse of FIG. 41 also differs from other dual element fuses which have been made by the McGraw-Edison Company in replacing the short-circuiting chambers of those dual element fuses with the fusible element 646. Where the electric fuse of FIG. 41 will have an ampere rating in excess of one hundred amperes, the fusible element 646 will be replaced by a short-circuiting chamber which includes a tubular casing of glass melamine that has cylindrical end bells telescoped into the ends thereof and that has two or more of the fusible elements of the present invention electrically inter-connecting those end bells. By using the fusible elements of the present invention in such a short-circuiting chamber, it is possible to reduce the number of fusible elements that are required, and also to force the rate of rise of the overcurrent to start to diminish at a very low value. For example, the five fusible elements in the glass melamine short-circuiting chamber of a one hundred and ten ampere dual element fuse produced by the McGraw-Edison Company can be replaced by just three of the fusible elements 38 of FIG. 28.

Current normally flows from the knife blade terminal 628 via conductor 642, connector 648, heat absorber 640, the tab of the fusible element 646, and the rest of that fusible element to the knife blade terminal 634. In the event a low but potentially-hurtful overcurrent develops and continues for a predetermined length of time, the heat which is generated by the conductor 642 and by the fusible element 646 will cause the temperature of the heat absorber 640 to rise to the softening temperature of the solder which normally holds the connector 648 against movement. As that solder softens, the spring 650 will pull that connector away from the right-hand end of the conductor 642, and will thereby open the circuit.

In the event a high overcurrent develops, the controlling weak spots that are in the fusible element 646 will open, and will thereby force the rate of rise of the overcurrent to start to diminish. The arcs which develop as those controlling weak spots fuse will start burning into the dependent weak spots of that fusible element; and, as soon as the cross sections of those dependent weak spots have been sufficiently reduced by that burning, those dependent weak spots also will fuse. At such time, there will be three wide series-arranged arcs within the electric fuse of FIG. 41 — each constituted by the merged arcs at a controlling weak spot and at the adjacent dependent weak spot. By utilizing the fusible element 646, instead of fusible elements which have a number of series-arranged weak spots, the present invention makes it possible for the electric fuse of FIG. 41 to provide even more prompt diminishing of the rate of rise of the overcurrent, and to be even more sturdy and rugged.

Figure 42:
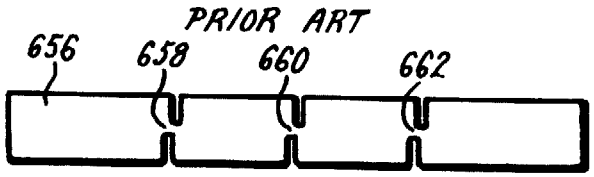
FIG. 42. PRIOR ART
FIG. 42 is a plan view of a prior art fusible element that will, in many cases, be replaced by the fusible element of FIG. 1.

Referring to FIG. 42, the numeral 656 denotes the fusible element that is fed in the KAX fuses which are marketed by the McGraw-Edison Company; and that fusible element has weak spots 658, 660 and 662. Each of those weak spots is defined by a pair of rectangular notches that extend inwardly from the opposite edges of that fusible element and that are offset axially of that fusible element, as shown in FIG. 42; and each of those weak spots is twenty thousandths of an inch wide. The fusible element 656 is made of silver, has a width of two hundred and fifteen thousandths of an inch, and has a length of two and fifteen thousandths of an inch; and each of the notches has a width of twenty thousandths of an inch. The center-to-center spacing between the weak spots 658, 660 and 662 is forty-one hundredths of an inch. Where that fusible element has a thickness of twenty-one ten-thousandths of an inch, an electric fuse which incorporates that fusible element, which has a glass melamine housing, and which is filled with sand will have a rating of 35 amperes; and where the thickness of that fusible element is thirty-six ten-thousandths of an inch, that electric fuse will have a rating of 60 amperes.

The weak spots 658, 660 and 662 are arranged in electrical series relation, and hence they will enable the fusible element 656 to provide the desirable current-interrupting characteristics of a fusible element which has three series-arranged weak spots that fuse simultaneously. However, the resistances of the weak spots 658, 660 and 662 are additive. Further, each of those weak spots is the sole connection between adjacent portions of that fusible element. Consequently, both from an electrical and mechanical point of view, each of the weak spots 658, 660 and 662 must have a greater cross section than either of the controlling weak spots 62 and 64 of the fusible element 50 of FIG. 1. As a result, even though the fusible element 656 of FIG. 42 will be able to force the rate of rise of a potentially-hurtful overcurrent to start to diminish at a low value, the fusible element 50 is able to force the rate of rise of such a potentially-hurtful overcurrent to start to diminish at an even lower value.

Figure 43:
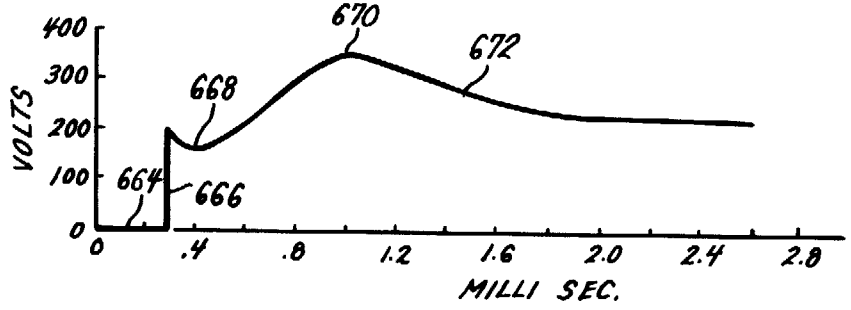
FIG. 43 is a voltage-time curve of an electric fuse that includes the prior art fusible element of FIG. 42.
Figure 44:
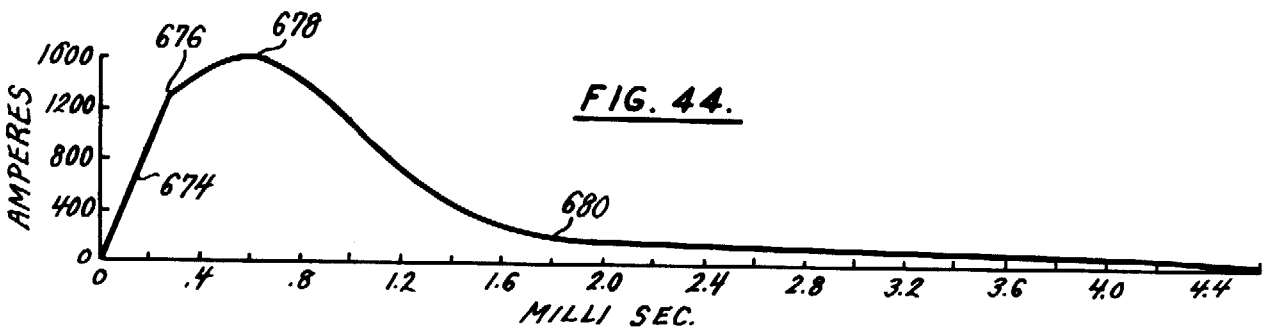
FIG. 44 is a current-time curve of the electric fuse that includes the prior art fusible element of FIG. 42.

FIG. 43 shows the voltage curve which developed when a sixty ampere KAX fuse opened the circuit in response to an overcurrent of potentially ten thousand amperes. Voltages from zero to three hundred and fifty volts are plotted along the ordinate, while time from zero through two and one half milliseconds is plotted along the abscissa. FIG. 44 shows the current curve which developed when that KAX fuse opened the current in response to that overcurrent; and currents in the range of 0 to 1600 amperes are plotted along the ordinate, while time from zero through four and five-tenths milliseconds is plotted along the abscissa.

The overcurrent was initiated at time zero; and the current immediately started to rise at a sharp rate, as shown by the line 674 in FIG. 44. However, as long as all of the weak spots 658, 660 and 662 of the fusible element 656 remained intact, the voltage across that fusible element was so close to zero that it can be represented by the zero-value line 664 in FIG. 43. As those three weak spots responded to the overcurrent to fuse simultaneously, the voltage rose abruptly along the line 666 to a value of about two hundred volts; and the rate of rise of the current started to diminish, as indicated by the point 676 in FIG. 44. The voltage dipped momentarily, as indicated by the portion 668 of the voltage curve in FIG. 43; and then that voltage increased until it reached a peak value of three hundred and fifty volts about one and two-hundredths of a millisecond after the initiation of the overcurrent, as indicated by the numeral 670. Thereafter, the voltage decreased along the line 672 until it reached a voltage of about 225 volts at about two and one-half milliseconds after the initiation of the overcurrent. Although the rate of rise of the overcurrent started to diminish at the point 676, that overcurrent continued to rise until it reached a peak of about sixteen hundred amperes; and it reached that peak about sixty-two hundredths of a millisecond after the overcurrent was initiated; and that peak is denoted by the numeral 678 in FIG. 44. Thereafter, the value of the current was rapidly reduced, so that it was reduced to 200 amperes within one and eight tenths of a millisecond after the overcurrent was initiated, as indicated by the point 680 in FIG. 44. Subsequently, the current is progressively reduced to zero reaching zero approximately four and five tenths of a millisecond after the initation of the overcurrent.

The fusible element 656 of that sixty ampere KAX fuse was dimensioned to "let through" a peak current of sixteen hundred amperes, as shown by point 678 on the current curve in FIG. 44; but that element forced the rate of rise of the potentially-hurtful overcurrent to start to diminish at the relatively-low value of thirteen hundred amperes. That fusible element started to diminish that rate of rise in just three-tenths of a millisecond, and then it reduced the current to zero within four and one-half milliseconds from the time the overcurrent was initialed — thereby providing prompt diminishing of the rate of rise of the potentially-hurtful overcurrent and also effecting prompt reduction of the current to zero. The oscillograms, from which the curves of FIGS. 43 and 44 were made, were developed by connecting the sixty amperes KAX fuse in a highly-inductive, two hundred and fifty volt, D.C. circuit which was supplied by a capacitor bank. Consequently, the opening of the circuit, and the reducing of the current to zero, was not aided by an alternation of the current which can happen when an electric fuse is "blown" in an A.C. circuit. The curves of FIGS. 43 and 44 thus show that the KAX fuse is an exceedingly rapid-acting and effective current-limiting electric fuse.

Figure 46:
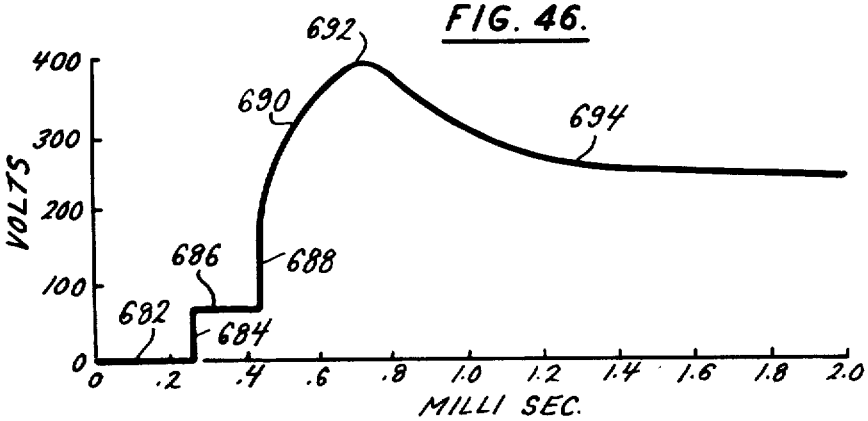
FIG. 46 is a current-time curve of the electric fuse that includes the fusible element of FIG. 1.
Figure 45:
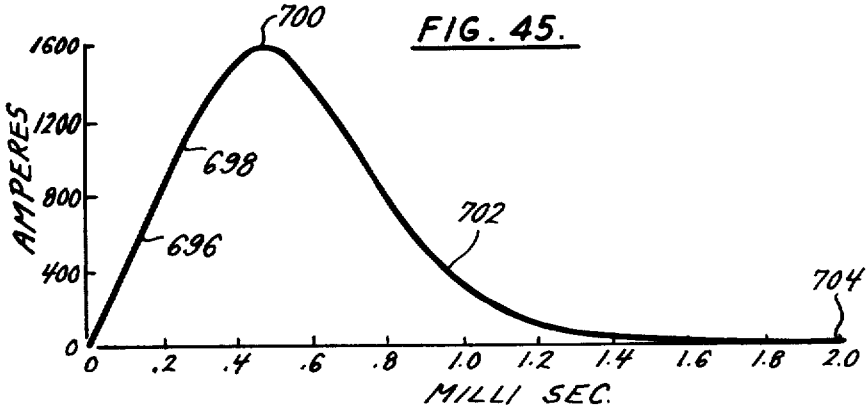
FIG. 45 is a voltage-time curve of an electric fuse that includes the fusible element of FIG. 1.

FIG. 45 shows the current curve which developed when a sixty ampere fuse that included the fusible element 50 of FIG. 1 was blown in response to an overcurrent of potentially ten thousand amperes. Currents in the range of zero through sixteen hundred amperes are plotted along the ordinate, while time from zero through two milliseconds is plotted along the abscissa. FIG. 46 shows the voltage curve corresponding to the current curve of FIG. 45; and voltages from 0 to 400 volts are plotted along the ordinate, while time from 0 to 2 milliseconds is plotted along the abscissa.

The overcurrent was initiated at time zero; and the current immediately started to rise at a sharp rate, as shown by the line 696 in FIG. 45. However, as long as the controlling weak spots 62 and 64 remained intact, the voltage across the fusible element 50 was so close to zero that it can be represented by the zero-value line 682 in FIG. 46. As those controlling weak spots responded to the overcurrent to fuse simultaneously, the voltage rose abruptly along the line 684 in FIG. 46; and the rate of rise of the current started to diminish, as indicated by the point 698 in FIG. 45. The voltage remained constant during the almost two-tenths of a millisecond while the arcs at the controlling weak spots 62 and 64 were burning toward and into the dependent weak spots 66 and 68, as shown by the line 686 in FIG. 46; but the current continued to increase, although at a lesser rate. As the dependent weak spots 66 and 68 fused, the voltage rose along the essentially-vertical line 688, and then continued to rise along the curved line 690. The peak voltage of four hundred volts was reached approximately seventy-two hundreds of a millisecond after the initiation of the overcurrent, as indicated by the point 692; and thereafter the voltage decreased rather quickly until, at one and four-tenths milliseconds after the initiation of the overcurrent, that voltage was close to the system voltage, as indicated at the point 694. The peak current of sixteen hundred amperes was reached about the time the dependent weak spots 66 and 68 fused, as indicated by the point 700 on the curve in FIG. 45. Thereafter, that current was rapidly reduced — reaching a value of two hundred amperes approximately one and eight hundredths of a millisecond after the initiation of the overcurrent, as indicated at the point 702 in FIG. 45. Subsequently, the current was further reduced — essentially reaching zero approximately two milliseconds after the initiation of the overcurrent, as indicated at the point 704 on the curve of FIG. 45.

The sixty ampere fusible element 50 was dimensioned to "let through" a peak current of sixteen hundred amperes, as shown by point 700 on the current curve in FIG. 45; but that fusible element forced the rate of rise of the potentially hurtful overcurrent to start to diminish at the desirably low value of eleven hundred amperes. That fusible element started to diminish that rate of rise in just twenty-five hundredths of a millisecond, and then it reduced the current to zero within two milliseconds from the time that over-current was initated — thereby providng very prompt diminishing of the rate of the potentially-hurtful overcurrent and also effecting very prompt reduction of the current to zero. The oscillograms, from which the curves of FIGS. 45 and 46 were made, were developed by connecting the electric fuse with the sixty ampere fusible element 50 in a highly-inductive, two hundred and fifty volt, D.C. circuit which was supplied by a capacitor bank. Consequently, the opening of the circuit, and the reducing of the current to zero, was not aided by an alternation of the current which can happen when an electric fuse is "blown" in an A.C. circuit. The curves of FIGS. 45 and 46 thus show that the said electric fuse is even more rapid-acting than is the sixty ampere KAX fuse.

A comparison of the current curves of FIGS. 44 and 45 shows that although the KAX fuse "cleared" the circuit in the very fast time of four and five-tenths milliseconds, the 60 ampere fusible element 50 "cleared" the circuit in the even-faster time of 2 milliseconds. Further, that comparison shows tat the area under the curve in FIG. 45 is very much small than the area under the curve in FIG. 44. This means that the product of time and the square of the current — ($I^2t$) — is much smaller when the sixty ampere fusible element 50 opens the circuit than it is when the sixty ampere KAX fuse opens the circuit — even though that fuse is an extremely fast-acting, current-limiting, 250 volt electric fuse. The $I^2t$ value which develops when the 60 ampere fusible element 50 opens the circuit is only about eleven hundred and forty-three ampere squared seconds, whereas the $I^2t$ value which develops when the sixty ampere KAX fuse opens the circuit is about twenty-nine hundred and thirty-six ampere squared seconds. This shows that the fusible element 50 is able to provide an $I^2t$ value which is well below the $I^2t$ value provided by the fusible element 656 — even though the latter fusible element provides a very desirably low $I^2t$ value.

Conclusion: The drawing shows a number of specifically-different fusible elements, a number of specifically different slots in those fusible elements, a number of specifically-differently notches in those fusible elements, a number of specifically-different weak spots in those fusible elements, and a number of specifically-different locations of those weak spots. However, all of those fusible elements have several basic features in common. Specifically, each of those fusible elements has at least two electrical conducting paths that are in electrical parallel relation and that have the main parts thereof electically separated, has at least one controlling weak spot in each of those electrical conducting paths, has those controlling weak spots spaced apart in the longitudinal direction, has a dependent weak spot in an adjacent electrical conducting path, and has transversely-directed burning paths which cause those dependent weak spots to fuse before the arcs which develop at those two controlling weak spots can merge. As a result, each of those fusible elements is able to start forcing the rate of rise of overcurrent to start to diminish at a relatively low level, and yet is able to provide the desirable current-interrupting characteristics of an electric fuse which has a plurality of series-arranged weak spots that fuse simultaneously.

As indicated by the drawing, a slit, slot or insulating barrier usually will electrically separate the main parts of the parallel electric conducting paths of the fusible element. Also, that slit, slot or insulating barrier usually will coact with inwardly-extending notches or with the adjacent edges of the fusible element to define the controlling weak spots of that fusible element. Further, as shown by FIGS. 6 and 7, the controlling weak spots of a fusible element can be constituted by a plurality of narrow areas. Additionally, as shown in FIGS. 6 and 7, the dependend weak spots of a fusible element can be constituted by a plurality of narrow areas.

The main parts of the electrical conducting paths of the fusible elements 70 and 228, respectively, of FIGS. 3 and 16 are shown as being bowed to define ovate openings in side elevation. The main parts of the electrical conducting paths of the fusible elements 92, 124, 148, 160, 284, respectively, of FIGS. 4, 6, 8, 9, and 20 will preferably be bowed to define openings which have similar configurations in side elevation. However, if desired, the main parts of the electrical conducting paths of any or all of those fusible elements could be bowed so the openings which were defined by those main parts were rectangular in configuration or had any one of a number of configurations in side elevation. The primary requirements of the bending of the major parts of the electrical conducting paths of any fusible element are that the distance between any given controlling weak spot and its adjacent dependent weak spot should not exceed one-quarter of an inch and that those main parts should be continuously separated from each other.

The fusible elements provided by the present invention will preferably accommodate formed so they will not be fatigued by recurrent expansions and contractions of the lengths thereof due to thermal cycling of those fusible elements. The fusible elements which have the main parts of the electrical conducting paths thereof bowed will be inherently resistant to any such fatigue; because those bowed parts can readily yield to accommodate any expansions and contractions of the lengths of those fusible elements. Any of the fusible elements which does not have the main parts of the electrical conducting paths thereof bowed in opposite directions could have a short bend formed therein or could be bowed to be arcuate throughout its length to enable it to accomodate any expansions or contractions of the length thereof due to thermal cycling. Consequently, even though the fusible elements provided by the present invention are made unusually thin, those fusible elements will not be fatigued by recurrent expansions and contractions of the lengths thereof due to thermal cycling of those fusible elements.

V-shaped notches, such as those shown in FIGS. 8, 11, 13, 14, 18, 23, 24, 26, 31, 32 and 39 require the punching-away of less metal than do the generally-triangular notches of FIGS. 1, 2, 9, 10, 28, 30, 37 and 38; and hence those V-shaped notches produce smaller increases in the resistances of the fusible elements than do those generally triangular notches. Also, the metal which defines those V-shaped notches can tend to absorb heat from the weak spots at a faster rate than can the metal which defines those generally-triangular notches. However, generally-triangular notches are desirable because they can be formed with less likelihood of a fatigue line extending into a weak spot. Also, generally-triangular notches are desirable because they keep the positioning and spacing of those notches and the slots or slits from being objectionably critical.

Where the voltage of the circuit, into which any of the fusible elements of the present invention is connected, is two hundred and fifty volts, it will be desirable to have one controlling weak spot and one dependent weak spot arranged in series relation in each electrical conducting path. Where that circuit voltage is higher than two hundred and fifty volts, it will be desirable to have two or more controlling weak spots and two or more dependent weak spots arranged in series relation in each electrical conducting path. If, somehow, a fusible element of the present invention were to be connected into a circuit which had a far smaller voltage than the voltage which that fusible element was intended to "see," that circuit voltage might be too small to cause the arcs at the controlling weak spots to burn away enough of the dependent weak spots to cause those latter weak spots to fuse. In that event, all of the controlling weak spots would fuse, and then the arcs would become extinguished long before the arc at one of those controlling weak spots could merge with the arc at any other of those controlling weak spots. Consequently, even if a fusible element of the present invention were, somehow, to be connected into a circuit which had a far smaller voltage than the voltage which that fusible element was intended to "see," that fusible element would be able to respond to a potentially hurtful overcurrent to open that circuit quickly and safely.

FIG. 31 shows a fusible element wherein just one slot is provided in each end, and wherein the number and orientation of the weak spots at each end are comparable. However, if desired, one of those ends could have more slots and more weak spots than does the other end. Similarly, FIG. 38 shows a fusible element wherein two slots are provided in each end, and wherein the number and orientation of the weak spots at each end are comparable. However, if desired, one of those ends could have more slots and more weak spots than does the other end.

The fusible elements of FIGS. 1–27, 37, 39 and 40 are shown as having the same length, namely, eight hundred and twenty-five thousandths of an inch. However, if desired, those fusible elements could be made longer. Further, if those fusible elements were to be used in circuits having voltages that were substantially less than two hundred and fifty volts, those fusible elements could be shortened.

Whereas the drawing and accompanying description have shown and described many preferred embodiments of the present invention, it should be apparent to those skilled in the art that various changes may be made in the form of the invention without affecting the scope thereof.

What I claim is:

1. An electric fuse that comprises terminals which can be secured to an electric circuit, a first electrical conducting path which extends between said terminals.

a second electrical conducting path which extends between said terminals and which is in electrical parallel relation with said first electrical conducting path, said terminals and said first and second electrical conducting paths being integral parts of the same piece of metal, said first electrical conducting path having a first weak spot therein which is dimensioned to respond to a predetermined level of current flowing through said first electrical conducting path to fuse before any nearby portion of said first electrical conducting path can fuse, said second electrical conducting path having a first weak spot therein which is dimensioned to respond to a second predetermined level of current flowing through said second electrical conducting path to fuse before any nearby portion of said second electrical conducting path can fuse, said first weak spot in said first electrical conducting path being displaced longitudinally relative to said first weak spot in said second electrical conducting path, said first electrical conducting path having the main part, of that length thereof which is located between said first weak spot thereof and a point which is in register with said first weak spot in said second electrical conducting path, physically disconnected from the corresponding part of said second electrical conducting path, said first weak spot in said first electrical conducting path acting, whenever it fuses, to form a first arc in said first electrical conducting path, said first weak spot in said second electrical conducting path acting, whenever it fuses, to form a first arc in said second electrical conducting path, said first electrical conducting path having a second weak spot therein which is close enough to said first weak spot in said second electrical conducting path to respond to said first arc that will develop in said second electrical conducting path, as said first weak spot in said second electrical conducting path fuses, to fuse and thereby form a second arc in said first electrical conducting path, said second electrical conducting path having a second weak spot therein which is close enough to said first weak spot in said first electrical conducting path to respond to said first arc that will develop in said first electrical conducting path, as said first weak spot in said first electrical conducting path fuses, to fuse and thereby form a second arc in said second electrical conducting path, said electric fuse acting, as long as the total current flowing therethrough is less than the sum of the first said and of said second predetermined levels, to provide two weak spots that are in electrical parallel relation but that are displaced longitudinally, said electric fuse acting, whenever the current flowing through said first weak spot in said first electrical conducting path exceeds said first said predetermined level and the current flowing through said first weak spot in said second electrical conducting path exceeds said second predetermined level, to permit said first arc to develop at said first weak spot in said first electrical conducting path and to permit said first arc to develop at said first weak spot in said second electrical conducting path and thereby provide two arcs in electrical parallel relation, said second weak spot in said first electrical conducting path responding to said first arc in said second electrical conducting path to fuse and develop said second arc in said first electrical conducting path, and said second weak spot in said second electrical conducting path responding to said first arc in said first electrical conducting path to fuse and develop said second arc in said second electrical conducting path, and thereby provide two arcs in electrical series relation in said first electrical conducting path while also providing two arcs in electrical series relation in said second electrical conducting path, said second arc in said first electrical conducting path coacting with said first arc in said first electrical conducting path to help reduce the current to zero, said second arc in said second electrical conducting path coacting with said first arc in said second electrical conducting path to help reduce the current to zero.

whereby said electric fuse has, under normal conditions of operation, the characteristics of parallel-arranged weak spots and has, at the time it opens the circuit therethrough, the current-interrupting effect of series-arranged arcs,

2. An electric fuse as claimed in claim 1 wherein said first weak spot in said first electrical conducting path and said second weak spot in said second electrical conducting path help define a burning path which extends transversely of said electric fuse and which has a thermal mass that is less than one-half of the thermal mass of any burning path which could develop between said first weak spot in said first electrical conducting path and said first weak spot in said second electrical conducting path, and wherein said first weak spot in said second electrical conducting path and said second weak spot in said first electrical conducting path help define a second burning path which extends transversely of said electric fuse and which has thermal mass that is less than one-half of the thermal mass of any burning path which could develop between said first weak spot in said first electrical conducting path and said first weak spot in said second electrical conducting path.

3. An electric fuse as claimed in claim 1 wherein the cross section of said second weak spot in said second electrical conducting path is larger than the cross section of said first weak spot in said first electrical conducting path, and wherein the cross section of said second weak spot in said first electrical conducting path is larger than the cross section in said first weak spot in said second electrical conducting path.

4. An electric fuse as claimed in claim 1 wherein the cross section of said first weak spot in said first electrical conducting path is substantially equal to the cross section of said first weak spot in said second electrical conducting path.

5. An electric fuse as claimed in claim 1 wherein the cross section of said second weak spot in said first electrical conducting path is less than one-half the maximum cross section of said electric fuse, and wherein the cross section of said second weak spot in said second electrical conducting path is less than one-half the maximum cross section of said electrical fuse.

6. An electric fuse as claimed in claim 1 wherein the cross section of said second weak spot in said first electrical conducting path is substantially equal to the cross section of said second weak spot in said second electrical conducting path.

7. An electrical fuse as claimed in claim 1 wherein the cross section of said first weak spot in said first electrical conducting path is substantially equal to the cross section of said first weak spot in said second electrical conducting path, and wherein the cross section of said second weak spot in said first electrical conducting path is substantially equal to the cross section of said second weak spot in said second electrical conducting path.

8. An electric fuse as claimed in claim 1 wherein the cross section of said second weak spot in said second electrical conducting path is larger than the cross section of said first weak spot in said first electrical conducting path but is less than eight times said cross section of said first weak spot in said first electrical conducting path, and wherein the cross section of said second weak spot in said first electrical conducting path is larger than the cross section of said first weak spot in said second electrical conducting path but is less than eight times said cross section of said first weak spot in said second electrical conducting path.

9. An electric fuse as claimed in claim 1 wherein the length and the cross section of said first weak spot in said first electrical conducting path are substantially equal to the length and the cross section of said first weak spot in said second electrical conducting path.

10. An electric fuse that comprises terminals which can be secured to an electric circuit, a first electrical conducting path which extends between said terminals.

a second electrical conducting path which extends between said terminals and which is in electrical parallel relation with said first electrical conducting path, said first electrical conducting path having a weak spot therein which is dimensioned to respond to a predetermined level of current flowing through said first electrical conducting path to fuse before any nearby portion of said first electrical conducting path can fuse, said second electrical conducting path having a weak spot therein which is dimensioned to respond to a second predetermined level of current flowing through said second electrical conducting path to fuse before any nearby portion of said second electrical conducting path can fuse, said weak spot in said first electrical conducting path being displaced longitudinally relative to said weak spot in said second electrical conducting path, said first electrical conducting path having at least part, of that length thereof which is located between said weak spot thereof and a point which is in register with said weak spot in said second electrial conducting path, physically disconnected from the corresponding part of said second electrical conducting path, said weak spot in said first electrical conducting path acting, whenever it fuses, to form a first arc in said first electrical conducting path, said weak spot in said second electrical conducting path acting, whenever it fuses, to form a first arc in said second electrical conducting path, said first electrical path having pathhaving a portion thereof which will respond to said first arc that will develop in said second electrical conducting path, as said weak spot in said second electrical conducting path fuses, to fuse and thereby form a second arc in said first electrical conducting path, said second electrical conducting path having a portion whereof which will respond to said first arc that will develop in said first electrical conducting path, as said weak spot in said first electrical conducting path fuses, to fuse and thereby form a second arc in said second electrical conducting path, said electric fuse acting, as long as the total current flowing therethrough is less than the sum of the first said and of said second predetermined levels, to provide two weak spots that are in electrical parallel relation but that are displaced longitudinally.

said electric fuse acting, whenever the current flowing through said weak spot in said first electrical conducting path exceeds the first said predetermined level and the current flowing through said weak spot in said second electrical conducting path exceeds said second predetermined level, to permit said first arc to develop in said first electrical conducting path and to permit said first arc to develop in said second electrical conducting path and thereby provide two arcs in electrical parallel relation, said portion of said first electrical conducting path responding to said first arc in said second electrical conducting path to fuse and develop said second arc in said first electrical conducting path, and said portion of said second electrical conducting path responding to said first arc in said first electrical conducting path to fuse and develop said second arc in said second electrical conducting path, and thereby provide two arcs in electrical series relation in said first electrical conducting path while also providing two arcs in electrical series relation in said second electrical conducting path, whereby said electric fuse has, under normal conditions of operation, the characteristics of parallel-arranged weak spots and has, at the time it opens the circuit therethrough, the current interrupting effect of series-arranged arcs.

11. An electric fuse as claimed in claim 10 wherein said first electrical conducting path is part of a first piece of metal, and wherein said second electrical conducting path is part of a second piece of metal.

12. An electric fuse as claimed in claim 10 wherein said first electrical conducting path is a wire, and wherein said second electrical conducting path is a second wire.

13. An electric fuse as claimed in claim 10 wherein said first electrical conducting path and said second electrical conducting path are coplanar.

14. An electric fuse as claimed in claim 10 wherein said first electrical conducting path lies in a given plane, and wherein said electrical conducting path lies in a second plane which is substantially parallel to but which is displaced from the first said plane.

15. An electric fuse as claimed in claim 10 wherein said first electrical conducting path lies in a given plane, wherein said second electrical conducting path lies in a second plane which is substantially parallel to but which is displaced from the first said plane, and wherein the confronting faces of said first and said second electrical conducting paths are spaced apart by a distance which does not exceed three thirty-seconds of an inch.

16. An electric fuse as claimed in claim 10 wherein said first electrical conducting path lies in a given plane, wherein said electrical conducting path lies in a second plane which is substantially parallel to but which is displaced from the first said plane, and wherein an insulating barrier is interposed between at least a portion of the confronting faces of said first and said second electrical conducting paths.

17. An electric fuse as claimed in claim 10 wherein said first electrical conducting path lies in a given plane, wherein said electrical conducting path lies in a second plane which is substantially parallel to but which is displaced from the first said plane, and wherein an insulating barrier is interposed between at least a portion of the confronting faces of said first and said second electrical conducting paths, but wherein said insulating barrier does not obstruct a burning path from said weak spot in said first electrical conducting path to said portion of said second electrical conducting path and does not obstruct a burning path from said weak spot in said second electrical conducting path to said portion of said first electrical conducting path.

18. An electric fuse as claimed in claim 10 wherein said main part of said first electrical conducting path is bent away from said corresponding part of said second electrical conducting path.

19. An electric fuse as claimed in claim 10 wherein said main part of said first electrical conducting path is bent away from said corresponding part of said second electrical conducting path, and wherein said corresponding part of said second electrical conducting path is bent away from said main part of said first electrical conducting path, but wherein the distance between said weak spot in said first electrical conducting path and said portion of said second electrical conducting path does not exceed one-quarter of an inch and wherein the distance between said weak spot in said second electrical conducting path and said portion of said first electrical conducting path does not exceed one-quarter of an inch.

20. An electric fuse as claimed in claim 1 wherein the length and the cross section of said second weak spot in said first electrical conducting path are substantially equal to the length and the cross section of said second weak spot in said second electrical conducting path.

21. An electric fuse as claimed in claim 1 wherein the length and the cross section of said first weak spot in said first electrical conducting path are substantially equal to the length and the cross section of said first weak spot in said second electrical conducting path, and wherein the length and the cross section of said second weak spot in said first electrical conducting path are substantially equal to the length and the cross section of said second weak spot in said second electrical conducting path.

22. An electric fuse as claimed in claim 1 wherein said terminals coact to define a plane, wherein said main part of said first electrical conducting path is bent out of said plane in one direction, and wherein said corresponding part of said second electrical conducting path is bent out of said plane in the opposite direction.

23. An electric fuse as claimed in claim 1 wherein said terminals coact to define a plane, wherein said main part of said first electrical conducting path is bent out of said plane in one direction and wherein said corresponding part of said second electrical conducting path is bent out of said plane in the opposite direction, but wherein the distance between said first weak spot in said first electrical conducting path and said second weak spot in said second electrical conducting path is less than one-quarter of an inch and wherein the distance between said first weak spot in said second electrical conducting path and said second weak spot in said first electrical conducting path is less than one-quarter of an inch.

24. An electric fuse as claimed in claim 10 wherein said part of said first electrical conducting path is displaced from said corresponding part of said second electrical conducting path by an elongated slot.

25. An electric fuse as claimed in claim 10 wherein said part of said first electrical conducting path is displaced from said corresponding part of said second electrical conducting path by an elongated slot, and wherein said elongated slot is shorter than the distance between said first weak spot in said first electrical conducting path and said first weak spot in said second electrical conducting path.

26. An electric fuse as claimed in claim 10 wherein said part of said first electrical conducting path is displaced from said corresponding part of said second electrical conducting path by an elongated slot, and wherein said elongated slot is longer than the distance between said first weak spot in said first electrical conducting path and said first weak spot in said second electrical conducting path.

27. An electric fuse as claimed in claim 10 wherein an elongated slot helps define said first weak spot in said first electrical conducting path, and wherein said elongated slot helps define said first weak spot in said second electrical conducting path.

28. An electric fuse as claimed in claim 1 wherein an elongated slot helps define said second weak spot in said first electrical conducting path, and wherein said elongated slot helps define said second weak spot in said second electrical conducting path.

29. An electric fuse as claimed in claim 1 wherein an elongated slot helps define said first weak spot in said first electrical conducting path, wherein said elongated slot helps define said first weak spot in said second electrical conducting path, wherein said elongated slot helps define said second weak spot in said first electrical conducting path, and wherein said elongated slot helps define said second weak spot in said second electrical conducting path.

30. An electric fuse as claimed in claim 10 wherein said part of said first electrical conducting path is displaced from said corresponding part of said second electrical conducting path by an elongated slot, wherein said elongated slot helps define said first weak spot in said first electrical conducting path, and wherein said elongated slot helps define said first weak spot in said second electrical conducting path.

31. An electric fuse as claimed in claim 1 wherein said main part of said first electrical conducting path is displaced from said corresponding part of said second electrical conducting path by an elongated slot, wherein said elongated slot helps define said second weak spot in said first electrical conducting path, and wherein said elongated slot helps define said second weak spot in said second electrical conducting path.

32. An electric fuse as claimed in claim 1 wherein said main part of said first electrical conducting path is displaced from said corresponding part of said second electrical conducting path by an elongated slot, wherein said elongated slot helps define said first weak spot in said first electrical conducting path, wherein said elongated slot helps define said first weak spot in said second electrical conducting path, wherein said elongated slot helps define said second weak spot in said first electrical conducting path, and wherein said elongated slot helps define said second weak spot in said second electrical conducting path.

33. An electric fuse as claimed in claim 1 wherein said main part of said first electrical conducting path is displaced from said corresponding part of said second electrical conducting path by an elongated slot, wherein the distance between said first weak spot in said first electrical conducting path and said second weak spot in said second electrical conducting path does not exceed one-quarter of an inch, and wherein the distance between said first weak spot in said second electrical conducting path and said second weak spot in said first electrical conducting path does not exceed one-quarter of an inch.

34. An electric fuse as claimed in claim 1 wherein said first weak spot in said first electrical conducting path is spaced from the adjacent terminal a distance greater than the distance by which said second weak spot in said second electrical conducting path is spaced from said adjacent terminal, and wherein said first weak spot in said second electrical conducting path is spaced from the other terminal a distance greater than the distance by which said second weak spot in said first electrical conducting path is spaced from said other terminal.

35. An electric fuse as claimed in claim 1 wherein said first weak spot in said first electrical conducting path and said second weak spot in said second electrical conducting path help define a path which extends transversely of said electric fuse, and wherein said first weak spot in said second electrical conducting path and said second weak spot in said first electrical conducting path help define a second path which extends transversely of said electric fuse.

36. An electric fuse as claimed in claim 1 wherein said first weak spot in said first electrical conducting path has at least two portions that are in electrical parallel relation, and wherein said first weak spot in said second electrical conducting path has at least two portions that are in electrical parallel relation.

37. An electric fuse as claimed in claim 10 wherein at least one of said weak spots has at least two portions that are in electrical parallel relation.

38. An electric fuse as claimed in claim 1 wherein the cross section of said first weak spot in said first electrical conducting path is substantially equal to the cross section of said first weak spot in said second electrical conducting path, whereby the current which flows through said first electrical conducting path will, at any given instant, be substantially equal to the current which flows through said second electrical conducting path.

39. An electric fuse that comprises terminals which can be secured to an electric circuit, a first electric conducting path which extends between said terminals, a second electrical conducting path which extends between said terminals and which is in electrical parallel relation with said first electrical conducting path, said first electrical conducting path having a weak spot therein which is dimensioned to respond to a predetermined level of current flowing through said first electrical conducting path to fuse before any nearby portion of said first electrical conducting path can fuse, said second electrical conducting path having a weak spot therein which is dimensioned to respond to a second predetermined level of current flowing through said second electrical conducting path to fuse before any nearby portion of said second electrical conducting path can fuse, said weak spot in said first electrical conducting path being displaced longitudinally relative to said weak spot in said second electrical conducting path, said first electrical conducting path having at least part, of that length thereof which is located between said weak spot thereof and a point which is in register with said weak spot in said second electrical conducting path, physically disconnected from the corresponding part of said second electrical conducting path, said weak spot in said first electrical conducting path acting, whenever it fuses, to form a first arc in said first electrical conducting path, said weak spot in said second electrical conducting path acting, whenever it fuses, to form a first arc in said second electrical conducting path, a first burning path that extends transversely of said electric fuse and that permits said first arc that will develop in said second electrical conducting path, as said weak spot in said second electrical conducting path fuses, to burn away enough of an adjacent portion of said first electrical conducting path to enable said adjacent portion of said first electrical conducting path to fuse and thereby form a second arc in said first electrical conducting path, a second burning path that extends transversely of said electric fuse and that permits said first arc that will develop in said first electrical conducting path, as said weak spot in said first electrical conducting path fuses, to burn away enough of an adjacent portion of said second electrical conducting path to enable said adjacent portion of said second electrical conducting path to fuse and thereby form a second arc in said second electrical conducting path, said electric fuse acting, as long as the total current flowing therethrough is less than the sum of the first said and of said second predetermined levels, to provide two weak spots that are in electrical parallel relation but that are displaced longitudinally, said electric fuse acting, whenever the current flowing through said weak spot in said first electrical conducting path exceeds the first said predetermined level and the current flowing through said weak spot in said second electrical conducting path exceeds said second predetermined level, to permit said first arc to develop in said first electrical conducting path and to permit said first arc to develop in said second electrical conducting path and thereby provide two arcs in electrical parallel relation, said portion of said first electrical conducting path responding to burning which occurs along said first burning path, as said weak spot in said second electrical conducting path fuses, to fuse and develop said second arc in said first electrical conducting path, and said portion of said second electrical conducting path responding to burning which occurs along said second burning path, as said weak spot in said first electrical conducting path fuses, to fuse and develop said second arc in said second electrical conducting path, and thereby provide two arcs in electrical series relation in said first electrical conducting path while also providing two arcs in electrical series relation in said second electrical conducting path, whereby said electric fuse has, under normal conditions of operation, the characteristics of parallel-arranged weak spot and has, at the time it opens the circuit therethrough, the current-interrupting effect of series-arranged arcs, said burning which occurs along said first burning path, as said weak spot in said second electrical conducting path fuses, causing said portion of said first electrical conducting path to fuse before one-half of the length of any longitudinally-extending burning path between said weak spot in said first electrical conducting path and said weak spot in said second electrical conducting path can burn away, said burning which occurs along said second burning path, as said weak spot in said first electrical conducting path fuses, causing said portion of said second electrical conducting path to fuse before one-half of the length of any longitudinally-extending burning path between said weak spot in said first electrical conducting path and said weak spot in said second electrical conducting path can burn away.

40. An electric fuse as claimed in claim 10 wherein said first electrical conducting path and said second electrical conducting path are integral parts of one piece of metal that constitutes a fusible element, wherein said portion of said first electrical conducting path coacts with said weak spot in said second electrical conducting path to help stiffen said fusible element, and wherein said portion of said second electrical conducting path coacts with said weak spot in said first electrical conducting path to help stiffen said fusible element.

41. An electric fuse as claimed in claim 10 wherein said first said predetermined level of current is substantially equal to said second predetermined level of current.

42. An electric fuse as claimed in claim 39 wherein one end of an elongated slot is adjacent said first burning path, and wherein the opposite end of said elongated slot is adjacent said second burning path.

43. An electric fuse as claimed in claim 39 wherein one end of an elongated slot extends through said first burning path, and wherein the opposite end of said elongated slot extends through said second burning path.

44. An electric fuse as claimed in claim 39 wherein one end of an elongated slit is adjacent said first burning path, and wherein the opposite end of said elongated slit is adjacent said second burning path.

45. An electric fuse as claimed in claim 39 wherein one end of an elongated slit extends through said first burning path, and wherein the opposite end of said elongated slit extends through said second burning path.

46. An electric fuse as claimed in claim 39 wherein said first electrical conducting path is part of a first conductor, and wherein said second electrical conducting path is part of a separate and distinct conductor.

47. An electric fuse as claimed in claim 39 wherein said first electrical conducting path is part of a one-piece fusible element, and wherein said second electrical conducting path is part of said one-piece fusible element.

48. An electric fuse as claimed in claim 1 wherein the current density in either of said first weak spots will be greater than the current density in either of said second weak spots, and wherein said current density in either of said second weak spots will be greater than the current density in the largest cross section portion of either of said electrical conducting paths.

49. An electric fuse as claimed in claim 10 wherein the current density in either of said weak spots will be greater than the current density in either of said portions of said electrical conducting paths, and wherein said current density in either of said portions of said electrical conducting paths will be greater than the current density in the largest cross section portion of either of said electrical conducting paths.

50. An electric fuse as claimed in claim 10 wherein the cross section of said portion of said first electrical conducting path is greater than the cross section of said weak spot in said second electrical conducting path, and wherein the cross section of said portion of said second electrical conducting path is greater than the cross section of said weak spot in said first electrical conducting path.

51. An electric fuse as claimed in claim 10 wherein the cross section of said portion of said first electrical conducting path is greater than the cross section of said weak spot in said second electrical conducting path but does not exceed eight times the ratio of the current in said portion to the current in said weak spot, and wherein the cross section of said portion of said second electrical conducting path is greater than the cross section of said weak spot in said first electrical conducting path but does not exceed eight times the ratio of the current in said portion of said second electrical conducting path to the current in said weak spot in said first electrical conducting path.

52. An electric fuse as claimed in claim 10 wherein said first electrical conducting path and said second electrical conducting path are integral parts of one piece of metal that constitutes a fusible element, wherein the distance between said controlling weak spot in said first electrical conducting path and said controlling weak spot in said second electrical conducting path is not substantially greater than the length of said first electrical conducting path wherein said weak spot in said first electrical conducting path is spaced from said portion of said second electrical conducting path by a distance which does not exceed one-quarter of an inch, and wherein said weak spot in said second electrical conducting path is spaced from said portion of said first electrical conducting path by a distance which does not exceed one-quarter of an inch.

53. An electric fuse as claimed in claim 10 wherein said first electrical conducting path is part of a first conductor, wherein said second electrical conducting path is part of a separate and distinct conductor, and wherein said first conductor is spaced from said second conductor by a distance which does not exceed three thirty-seconds of an inch.

54. An electric fuse as claimed in claim 10 wherein said weak spot in said first electrical conducting path acts as a controlling weak spot, wherein said portion of said second electrical conducting path acts as a dependent weak spot, wherein the arc forms as said portion of said second electrical conducting path fuses will merge with the arc which forms as said weak spot in said first electrical conducting path fuses to form a first controlling-dependent arc, wherein said weak spot in said second electrical conducting path acts as a controlling weak spot, wherein said portion of said first electrical conducting path acts as a dependent weak spot, wherein the arc which forms as said portion of said first electrical conducting path fuses will merge with the arc which forms as said weak spot in said second electrical conducting path fuses to form a second controlling-dependent arc, and wherein the number of controlling-dependent weak spots in said electric fuse equals the number of controlling weak spots in said electric fuse.

55. An electric fuse that has a first electrical conducting path, a second electrical conducting path which is in electrical parallel relation with said first electrical conducting path, said first electrical conducting path having a controlling weak spot therein and said second electrical conducting path having a controlling weak spot therein so said electric fuse has a plurality of controlling weak spots therein, said controlling weak spot in said first electrical conducting path being displaced longitudinally from said controlling weak spot in said second electrical conducting path, said controlling weak spot in said first electrical conducting path acting, whenever it fuses, to form a first arc in said first electrical conducting path, said controlling weak spot in said second electrical conducting path acting, whenever it fuses, to form a first arc in said second electrical conducting path, said first electrical conducting path having a dependent weak spot therein and said second electrical conducting path having a dependent weak spot therein so said electric fuse has a plurality of dependent weak spots therein, each of said plurality of controlling weak spots responding to a predetermined overcurrent to fuse and to form an arc, said dependent weak spot in said first electrical conducting path being adjacent said controlling weak spot in said second electrical conducting path and responding to said first arc in said second electrical conducting path to fuse and thereby form a second arc in said first electrical conducting path which will coact with said first arc in said second electrical conducting path to form a controlling-dependent arc, said dependent weak spot in said second electrical conducting path being adjacent said controlling weak spot in said first electrical conducting path and responding to said first arc in said first electrical conducting path to fuse and thereby form a second arc in said second electrical conducting path which will coact with said first arc in said first electrical conducting path to form a second controlling-dependent arc, said electric fuse acting, as long as the value of the current flowing therethrough is less than said predetermined overcurrent, to provide two weak spots that are in electrical parallel relation but that are longitudinally displaced from each other, and responding to said predetermined overcurrent to form two longitudinally spaced arcs which become series-arranged controlling-dependent arcs, whereby said electric fuse has, under normal conditions of operation, the characteristics of parallel-arranged weak spots and has, at the time it opens the circuit therethrough, the current interrupting effect of series-arranged arcs.

56. An electric fuse as claimed in claim 10 wherein an elongated slot physically separates said part of said first electrical conducting path from said corresponding part of said second electrical conducting path, and wherein said elongated slot is non-linear.

57. An electric fuse as claimed in claim 10 wherein an elongated slot physically separates said part of said first electrical conducting path from said corresponding part of said second electrical conducting path, wherein a notch and said elongated slot coact to define said weak spot in said first electrical conducting path, and wherein a second notch and said elongated slot coact to define said weak spot in said second electrical conducting path.

58. An electric fuse as claimed in claim 10 wherein an elongated slot physically separates said part of said first electrical conducting path from said corresponding part of said second electrical conducting path, wherein a notch and said elongated slot coact to define said weak spot in said first electrical conducting path, wherein a second notch and said elongated slot coact to define said weak spot in said second electrical conducting path, wherein a third notch and said elongated slot coact to define said portion of said first electrical conducting path, and wherein a fourth notch and said elongated slot coact to define said portion of said second electrical conducting path.

59. An electric fuse as claimed in claim 10 wherein an elongated slit and a bow in said part of said first electrical conducting path help physically separate said part of said first electrical conducting path from said corresponding part of said second electrical conducting path.

60. An electric fuse as claimed in claim 10 wherein an elongated slit and a bow in said part of said first electrical conducting path help physically separate said part of said first electrical conducting path from said corresponding part of said second electrical conducting path, wherein a notch and said elongated slit coact to define said weak spot in said first electrical conducting path, and wherein a second notch and said elongated slit coact to define said weak spot in said second electrical conducting path.

61. An electric fuse as claimed in claim 10 wherein an elongated slit and a bow in said part of said first electrical conducting path help physically separate said part of said first electrical conducting path from said corresponding part of said second electrical conducting path, and wherein holes coact with said elongated slit to define said weak spots in said electrical conducting paths.

62. An electric fuse as claimed in claim 10 wherein an elongated slot physically separates said part of said first electrical conducting path from said corresponding part of said second electrical conducting path, and wherein holes coact with said elongated slot to define said weak spots in said electrical conducting paths.

63. An electric fuse as claimed in claim 10 wherein an elongated slit and a bow in said part of said first electrical conducting path help physically separate said part of said first electrical conducting path from said corresponding part of said second electrical conducting path, and wherein further slits coact with said elongated slit to define said weak spots in said electrical conducting paths.

64. An electric fuse as claimed in claim 10 wherein said weak spot in said first electrical conducting path is a zero length weak spot, and wherein said weak spot in said second electrical conducting path is a zero length weak spot.

65. An electric fuse as claimed in claim 10 wherein a third electrical conducting path extends between said terminals, wherein said third electrical conducting path has a weak spot therein which is dimensioned to respond to a third predetermined level of current flowing through said third electrical conducting path to fuse before any nearby portion of said third electrical conducting path can fuse, wherein said weak spot in said third electrical conducting path is displaced longitudinally relative to said weak spots in said first and second electrical conducting paths, wherein said third electrical conducting path has at least part, of that length thereof which is located between said weak spot thereof and a point which is in register with said weak spot in said second electrical conducting path, physically disconnected from the corresponding part of said second electrical conducting path, and has at least part, of that length thereof which is located between said weak spot thereof and a point which is in register with said weak spot in said first electrical conducting path, physically disconnected from the corresponding part of said first electrical conducting path, wherein said weak spot in said third electrical conducting path acts, whenever it fuses, to form a first arc in said third electrical conducting path, wherein said first electrical conducting path having a portion thereof which is close enough to said weak spot in said third electrical conducting path to respond to said first arc that will develop in said third electrical conducting path, as said weak spot in said third electrical conducting path fuses, to fuse and thereby form a second arc in said first electrical conducting path, wherein said second electrical conducting path having a portion thereof which is close enough to said weak spot in said third electrical conducting path to respond to said first arc that will develop in said third electrical conducting path, as said weak spot in said third electrical conducting path fuses, to fuse and thereby form a second arc in said second electrical conducting path, and wherein three series-arranged arcs form in said electric fuse as said electric fuse opens the circuit.

66. An electric fuse as claimed in claim 55 wherein at least a portion of said first electrical conducting path is physically displaced from a portion of said second electrical conducting path, wherein one of said controlling weak spots is in said portion of said first electrical conducting path, and wherein the other of said controlling weak spots is in said portion of said second electrical conducting path.

67. An electric fuse as claimed in claim 55 wherein an additional controlling weak spot is in said first electrical conductng path but is spaced longitudinally from the first said controlling weak spot and also from said dependent weak spot in said first electrical conducting path whereby a plurality of longitudinally-spaced controlling weak spots are in said first electrical conducting path, and wherein an additional controlling weak spot is in said second electrical conducting path but is spaced longitudinally from the first said controlling weak spot and also from said dependent weak spot in said second electrical conducting path whereby a plurality of longitudinally spaced controlling weak spots are in said second electrical conducting path.

68. An electric fuse as claimed in claim 10 wherein a means, which is responsive to low but potentially-hurtful overcurrents, is connected in series relation with said electrical conductive paths, and wherein said means relieves said weak spots of the need of responding to said low but potentially-hurtful overcurrents.

69. An electric fuse as claimed in claim 10 wherein a portion of a dual element fuse, which is responsive to low but potentially-hurtful overcurrents, is connected in series relation with said electrical conducting paths, and wherein said portion of said dual element relieves said weak spots of the need of responding to said low but potentially hurtful overcurrents.

70. An electric fuse that comprises terminals which can be secured to an electric circuit, a first electrical conducting path which extends between said terminals, a second electrical conducting path which extends between said terminals and which is in electrical parallel relation with said first electrical conducting path, said first electrical conducting path having a weak spot therein which is dimensioned to respond to a predetermined level of current flowing through said first electrical conducting path to fuse before any nearby portion of said first electrical conducting path can fuse, said second electrical conducting path having a weak spot therein which is dimensioned to respond to a second predetermined level of current flowing through said second electrical conducting path to fuse before any nearby portion of said second electrical conducting path can fuse, said weak spot in said first electrical conducting path being displaced longitudinally relative to said weak spot in said second electrical conducting path, said first electrical conducting path having the main part, of that length thereof which is located between said weak spot thereof and a point which is in register with said weak spot in said second electrical conducting path, physically disconnected from the corresponding part of said second electrical conducting path, said weak spot in said first electrical conducting path acting, whenever it fuses, to form a first arc in said first electrical conducting path, said weak spot in said second electrical conducting path acting, whenever it fuses, to form a first arc in said second electrical conducting path, said first electrical conducting path having a portion thereof which is close enough to said weak spot in said second electrical conducting path to respond to said first arc that will develop in said second electrical conducting path, as said weak spot in said second electrical conducting path fuses, to fuse and thereby form a second arc in said first electrical conducting path, said second electrical conducting path having a portion thereof which is close enough to said weak spot in said first electrical conducting path to respond to said first arc that will develop in said first electrical conducting path, as said weak spot in said first electrical conducting path fuses, to fuse and thereby form a second arc in said second electrical conducting path, said electric fuse acting, as long as the total current flowing therethrough is less than the sum of the first said and of said second predetermined levels, to provide two weak spots that are in electrical parallel relation but that are displaced longitudinally, said electric fuse acting, whenever the current flowing through said weak spot in said first electrical conducting path exceeds the first said predetermined level and the current flowing through said weak spot in said second electrical conducting path exceeds said second predetermined level, to permit said first arc to develop in said first electrical conducting path and to permit said first arc to develop in said second electrical conducting path and thereby provide two arcs in electrical parallel relation, said portion of said first electrical conducting path responding to said first arc in said second electrical conducting path to fuse and develop said second arc in said first electrical conducting path, and said portion of said second electrical conducting path responding to said first arc in said first electrical conducting path to fuse and develop said second arc in said second electrical conducting path, and thereby provide two arcs in electrical series relation in said first electrical conducting path while also providing two arcs in electrical series relation in said second electrical conducting path, said second arc in said first electrical conducting path being in series with said first arc in said first electrical conducting path and coacting with said first arc in said first electrical conducting path to help reduce the current to zero, said second arc in said second electrical conducting path being in series with said first arc in said second electrical conducting path and coacting with said first arc in said second electrical conducting path to help reduce the current to zero, whereby said electric fuse has, under normal conditions of operation, the characteristics of parallel-arranged weak spots and has, at the time it opens the circuit therethrough, the current-interrupting effect of series-arranged arcs.

71. An electric fuse as claimed in claim 10 wherein alloying material on said electrical conducting paths can respond to low but potentially-hurtful overcurrents, to cause said electrical conducting paths to fuse, and wherein said alloying material relieves said weak spots of the need of responding to said low but potentially-hurtful overcurrents.

72. An electric fuse as claimed in claim 10 wherein metal plates are secured to said electrical conducting paths to increase the thermal mass of said electrical conducting paths.

* * * * *